US011424557B2

(12) United States Patent
Chen

(10) Patent No.: US 11,424,557 B2
(45) Date of Patent: Aug. 23, 2022

(54) TWO-POINTS-AND-ONE-LINE PUSH-IN TERMINAL CAPABLE OF SECURE POSITIONING AND CONNECTOR USING THE SAME

(71) Applicant: RICH BRAND INDUSTRIES LIMITED, Dongguan (CN)

(72) Inventor: Tsan-Chi Chen, New Taipei (TW)

(73) Assignee: RICH BRAND INDUSTRIES LIMITED, Dongguan (CN)

( * ) Notice: Subject to any disclaimer, the term of this patent is extended or adjusted under 35 U.S.C. 154(b) by 11 days.

(21) Appl. No.: 17/215,180

(22) Filed: Mar. 29, 2021

(65) Prior Publication Data

US 2022/0102876 A1 Mar. 31, 2022

(30) Foreign Application Priority Data

Sep. 25, 2020 (TW) ..... 109133324

(51) Int. Cl.
*H01R 4/48* (2006.01)
*H01R 11/09* (2006.01)

(52) U.S. Cl.
CPC ..... *H01R 4/4818* (2013.01); *H01R 11/09* (2013.01)

(58) Field of Classification Search
CPC ..... H01R 4/4818; H01R 11/09
See application file for complete search history.

(56) References Cited

U.S. PATENT DOCUMENTS 2,122,252 A * 6/1938 Hayes ..... H01R 4/22 174/87
4,585,902 A * 4/1986 Munroe ..... H01R 4/4818 439/439
5,454,730 A * 10/1995 Tozuka ..... H01R 4/4818 439/441
5,626,488 A * 5/1997 Albeck ..... H01R 4/2429 439/441
6,210,207 B1 * 4/2001 Kozel ..... H01R 4/489 439/441

(Continued)

FOREIGN PATENT DOCUMENTS

CN 101325288 B 8/2011
JP S57-165974 A 10/1982

(Continued)

*Primary Examiner* — Briggitte R. Hammond
(74) *Attorney, Agent, or Firm* — CIPO IP Group

(57) ABSTRACT

A two-points-and-one-line push-in terminal capable of secure positioning includes a terminal body and a busbar, and can be mounted in a housing to form a connector. The terminal body is formed by stamping and bending an elastic metal plate, has a U-shaped longitudinal cross section, and includes a front upstanding insertion leg, a horizontal joining foot, and a rear upstanding insertion leg. The elastic metal plate can be divided by at least two slits into at least four independent sections, each having a U-shaped slit defining a pressing spring finger and a pressing frame. The busbar can be mounted on the horizontal joining foot. An electric wire can be passed through a corresponding pair of the U-shaped slits so as to abut against the free ends of the corresponding pressing spring fingers and the busbar and be restrained in the corresponding pressing frames, which serves as the two-points-and-one-line positioning mechanism.

4 Claims, 14 Drawing Sheets

(56) References Cited

U.S. PATENT DOCUMENTS

| | | | | |
|---|---|---|---|---|
| 6,257,919 | B1 * | 7/2001 | Cutler | H01R 4/4827 439/441 |
| 7,281,942 | B2 * | 10/2007 | Swedberg | H01R 4/4836 439/441 |
| 7,507,106 | B2 * | 3/2009 | Keswani | H01R 4/4818 439/439 |
| 7,833,038 | B1 * | 11/2010 | King, Jr | H01R 13/5216 439/936 |
| 8,192,226 | B2 * | 6/2012 | Keswani | H01R 4/4818 439/441 |
| 8,491,327 | B2 * | 7/2013 | Hartmann | H01R 31/085 439/441 |
| 8,579,650 | B2 * | 11/2013 | Keswani | H01R 4/4818 439/441 |
| 9,761,964 | B2 * | 9/2017 | Meyer | H01R 9/2416 |
| 10,236,597 | B2 * | 3/2019 | Meyer | H01R 4/4809 |
| 11,145,997 | B1 * | 10/2021 | Chen | H01R 4/4818 |
| 11,201,417 | B1 * | 12/2021 | Chen | H01R 4/4836 |
| 2011/0053406 | A1 * | 3/2011 | Lin | H01R 4/4818 439/358 |
| 2022/0102876 | A1 * | 3/2022 | Chen | H01R 11/09 |

FOREIGN PATENT DOCUMENTS

| | | | |
|---|---|---|---|
| JP | S58-184277 | A | 10/1983 |
| JP | H05-335038 | A | 12/1993 |
| JP | H15-2003243062 | A | 8/2003 |
| JP | H17-2005235711 | A | 9/2005 |

* cited by examiner

TWO-POINTS-AND-ONE-LINE PUSH-IN TERMINAL CAPABLE OF SECURE POSITIONING AND CONNECTOR USING THE SAME

CROSS-REFERENCE TO RELATED PATENT APPLICATION

This non-provisional application claims priority to and the benefit of, under 35 § 119(a), Taiwan Patent Application No. 109133324, filed in Taiwan on Sep. 25, 2020. The entire content of the above identified application is incorporated herein by reference.

FIELD

The present disclosure relates to a push-in connector, and more particularly to a structurally simplified push-in connector that allows a user who wishes to make a sale and secure electrical connection between the conductor at a stripped end of an electric wire and the busbar in the push-in connector to establish the electrical connection rapidly simply by holding the electric wire and pushing the conductor at the stripped end into a connection port of the push-in connector, without using any additional tool (e.g., pliers) or element (e.g., a connecting plate or insulating tape), and without the conductor at the stripped end of the electric wire being twisted or deformed when pushed into the push-in connector and there foie making it easy to perform an insulation displacement process or other operations on the push-in connector subsequently. In terms of the time required to complete the electrical connection, the push-in connector and the electric wire can be electrically connected more conveniently than achievable in the past. In terms of the result of the electrical connection, the "two-points-and-one-line" positioning mechanism between the push-in connector according to the present disclosure and the electric wire ensures that the conductor at the stripped end of the electric wire will stay secured at the correct mounting position regardless of the environment where the connection is made, and will not be twisted or damaged in the push-in connector due to drastic changes in the environment (e.g., when violent shaking, swinging, or vibration takes place in the environment). The push-in connector, therefore, ensures that the conductor at the stripped end of each electric wire connected thereto will be able to transmit electrical signals stably and safely.

BACKGROUND

A conventional electrical connector is an electrical connection device that enables electrical conduction between two electric devices and is conventionally formed by mounting a plurality of connecting elements (e.g., connecting plates and screws)) into a connector housing made of an insulating material. Generally, a conventional connector housing is provided therein with a hollow interior for receiving the connecting elements mounted therein, and is also formed with at least one connection port in communication with the hollow interior so that the conductor at the stripped end of at least one electric wire can be inserted into the hollow interior through the at least one connection port and fixed in the hollow interior with nothing more than a hand tool (e.g., a screwdriver or wrench) to establish an electrically conductive relationship between the conductor at the stripped end of the electric wire and a busbar connected to the connecting elements. Once the busbar is connected to a power source, the resulting electric circuit or system will be able to perform its intended electrical function. As the contact portion between the conductor at the stripped end of the electric wire and the busbar is completely enclosed in the sealed insulating environment formed by the connector housing, the safety and stability of the operation of the electric circuit or system are ensured.

Generally, electrical conduction in the foregoing conventional electrical connector is carried out through the connecting elements, in which the busbar and its connecting plate are positioned in the housing of the conventional electrical connector and are arranged and configured in such a way that an electrical connection can be made between the busbar, the connecting plate, and the conductor at the stripped end of each electric wire inserted into the housing, with the connecting plate providing an electrical conduction path between the busbar and each electric wire. The busbar serves mainly to connect with a power source and is therefore typically made of a highly electrically conductive material such as copper or tin-coated copper. However, even though the busbar is made of a highly electrically conductive material, the connecting plate will fail to provide proper electrical conduction between the conductor at a stripped end of an electric wire and the busbar if the conductor at the stripped end of the electric wire is not stably and firmly connected to the busbar. To ensure proper electrical conduction between the conductor at the stripped end of each electric wire and the busbar, it is common practice to provide the connecting plate of the busbar with a spring member that works with the busbar to make the conductor at the stripped end of each electric wire abut stably and firmly against the busbar, thereby ensuring that proper electrical conduction can always take place between the conductor at the stripped end of each electric wire and the busbar. This design concept has in the past few decades given rise to electrical connectors with various conventional spring members. These conventional spring members not only come in a plethora of configurations, but also are mounted in their respective connector housings in many different ways. Generally, each conventional spring member either is provided as an integral part of a connector housing, or is firmed as an independent component and then mounted at a corresponding position in the connector housing. The ultimate objective of such a conventional spring member, regardless of its configuration or mounting method, is to ensure and maintain stable and reliable mechanical connection and proper electrical conduction between the conductor at a stripped end of an electric wire and the busbar, whatever the circumstances may be. It should be pointed out that the means by which a conventional spring member makes the conductor at a stripped end of an electric wire stay in a connector housing is the retaining element on the conventional spring member. The conductor at the stripped end of the electric wire is kept in the connector housing by the retaining element working with the connector housing as well as the conductor at the stripped end of the electric wire. For example, the retaining element can engage with the conductor at the stripped end of the electric wire to prevent the conductor at the stripped end of the electric wire from being retracted axially from inside the connector housing; that is to say, the retaining element is aimed at holding the conductor at the stripped end of the electric wire stably and firmly in any event and therefore effectively preventing the conductor at the stripped end of the electric wire from arbitrary axial movement in and away from the connector housing. In some traditional designs of the conventional spring members, the retaining elements have a releasable configuration to facilitate removal of the conductor at a stripped end of an electric wire from inside a connector housing without damaging any part of the connector, which allows the electric wire to be easily removed from inside the connector housing whenever the electric wire needs to be replaced. Conversely, the retaining, elements in some traditional designs are deliberately configured to be non-releasable and thereby ensure that the conductor at a stripped end of an electric wire cannot be removed from inside a connector housing.

The retaining element on a conventional spring member is usually an integral part of the spring member so as to provide force facilitating sufficient contact between the conductor at a stripped end of an electric wire and the spring member and preventing the conductor at the stripped end of the electric wire from retracting out of the connector housing. Generally, the retaining element is an elastic metal structure integrally formed on the spring member. The conductor at a stripped end of an electric wire contacts the spring member when inserted into the connector housing and thereby bends the spring member and drives the spring member out of its position of equilibrium. As a result, the spring member is shifted angularly and generates a compression force that acts on the conductor at the stripped end of the electric wire. The conductor at the stripped end of the electric wire is therefore pressed tightly against, i.e., brought into close contact with and hence electrically connected to, the busbar by the compression force. The configuration and angle of the spring member are designed to allow the conductor at a stripped end of an electric wire that moves past the spring member to be inserted into the connector housing in a certain direction, and the design and structure of the additional retaining element on the spring member make it impossible to retract the conductor at the stripped end of the electric wire in the opposite direction, i.e., outward of the connector housing. Accordingly, the contact between the spring member and the conductor at the stripped end of the electric wire serves the dual function of pressing the conductor at the stripped end of the electric wire against the busbar and of effectively preventing the conductor at the stripped end of the electric wire from being retracted out of the connector housing. To press the conductor at a stripped end of an electric wire securely against the busbar, a stable structure capable of resisting the elastic compression force of the conventional spring member is required, but problems tend to arise when the conductor at a stripped end of an electric wire passed through the connector housing, and moved past the conventional spring member, and then is firmly held to the busbar by a supporting force jointly provided by the conventional spring member and the connector housing, in particular when the electric wire being connected is a stranded electric wire. For example, a stranded electric wire may be deformed (e.g., flattened) or splay when subjected to the pressing force of the spring member. Moreover, as the pressing force of the conventional spring member and its reaction force are generated only when the conventional spring member is shifted angularly, the splaying of a stranded electric wire may reduce, if not preventing, the angular shift and thus compromise the aforesaid dual function of the conventional spring member.

To effectively solve the problem of the dual function of the conventional spring member being compromised, Ideal Industries, Inc. of the United States developed a "push-in wire connector with improved busbar", for which patent applications were respectively filed in the United States on Jun. 14, 2007 and in China on Jun. 13, 2008, and for which U.S. Utility Pat. No. 7,507,106 B2 and China Invention Patent No. 101325288 B were respectively granted on Mar. 24, 2009 and Aug. 24, 2011 (hereinafter "Improved Busbar Patents") after the aforesaid applications were respectively examined. Referring to FIG. 1, the push-in connector 10 has a housing 12. Referring to FIG. 2, the housing 12 in the embodiment of the Improved Busbar Patents as shown in FIG. 1 is composed of two parts, namely a five-sided case 14 and a cap 16. The live-sided case 14 has a top wall 18 and a bottom wall 20 that are connected by a left sidewall 22 and a right sidewall 24, and a rear wall 26 closes the rear end of the five-sided case 14 such that the case walls and sidewalls jointly form the five-sided case 14 and define a hollow interior 28 of the five-sided case 14. Only the front side of the live-sided case 14 is open so as to secure and receive the cap 16. Referring again to FIG. 1, each of the sidewalk 22 and 24 has a latch 30. Each latch 30 can engage with a hook 32 protruding from the corresponding lateral side of the cap 16 in order to position and retain the cap 16 securely at the front side of the five-sided case 14. With continued reference to FIG. 1 and FIG. 2, the cap 16 is formed with and penetrated by a plurality of connection ports 34. The connection ports 34 provide access to the hollow interior 28 of the five-sided case 14. To ensure that the connection ports 34 are independent from and will not interfere with one another, at least one partition 36 may be provided in the hollow interior 28 of the five-sided case 14 to separate the adjacent connection ports 34 and to guide the conductor at a stripped end of an electric wire inserted through one of the connection ports 34 into the hollow interior 28 of the five-sided case 14 to the corresponding correct insertion position.

Referring to FIG. 2, FIG. 3, and FIG. 4, the push-in connector 10 generally further includes a spring assembly 38. The spring assembly 38 includes a spring member 42 and a busbar 40 fixed on the spring member 42. The spring member 42 is formed by stamping and bending a stainless-steel elastic metal plate and includes an upstanding leg 48 and a horizontal foot 44. The joint between the upstanding leg 48 and the horizontal foot 44 forms a bending line 46. The horizontal foot 44 is formed with a pair of rivet holes 41 for connecting with the busbar 40. Two slits 50 are thrilled in the upstanding leg 48 while the elastic metal plate is stamped. The slits 50 divide the elastic metal plate into three independent sections 52. Each slit 50 extends downward from the top edge of the upstanding leg 48 and terminates at a position adjacent in the bending line 46. Each independent section 52 further includes a U-shaped slit 54 that is formed by stamping, and the U-shaped slit 54 of each independent section 52 defines a restraining spring finger 56. Each restraining spring finger 56 is integrally connected to the corresponding independent section 52 at one end 57 and has an opposite free end 58 that extends slantingly toward the rear side of the hollow interior 28 of the five-sided case 14. As shown in FIG. 4 and FIG. 5, the end 58 (i.e., free end 58) of each restraining spring finger 56 is curved toward the rear side of the hollow interior 28 and extends toward the horizontal foot 44 such that the free end 58 and the remainder of the corresponding independent section 52 form an included angle θ at which the restraining, spring finger 56 can produce the optimal gripping and pressing force to thereby grip, and secure at the correct position, the conductor at a stripped end of an electric wire inserted into the push-in connector 10, with the conductor at the stripped end of the electric wire pressed securely against the top edge of the busbar 40 to establish a stable electrically conductive relationship between the conductor at the stripped end of the electric wire and the busbar 40.

Referring again to FIG. 1 and FIG. 2, it can be seen that the bottom wall 20 of the five-sided case 14 corresponds in configuration to a lower portion of the cap 16 so as to support the horizontal foot 44 of the spring member 42 effectively. By the same token, the portions of the cap 16 that extend into the hollow interior 28 of the live-sided case 14 are configured to engage with the upstanding leg 48 and cooperate with the at least one partition 36 extending into the hollow interior 28 of the five-sided case 14, so as to restrain the spring assembly 38 easily yet securely at a predetermined position in the five-sided case 14. Referring again to FIG. 1 FIG. 2, and FIG. 3, each restraining spring linger 56 corresponds to one of the connection ports 34 thrilled in the front wall of the cap 16, so that the conductor at a stripped end of each electric wire inserted into the hollow interior 28 of the five-sided case 14 through one of the connection ports 34 can touch the corresponding restraining spring finger 56 precisely and properly and bend the corresponding restraining spring finger 56 rearward and upward. The free end 58 of each restraining spring finger 56 thus bent will, thanks to its elastic restoring force, press firmly on the conductor at the stripped end of the corresponding electric wire to not only press the conductor at the stripped end of the corresponding electric wire against the busbar 40, forming a secure electrical connection therebetween, but also prevent the conductor at the stripped end of the corresponding electric wire from separating from the free end 58 of the restraining spring finger 56, so that the conductor at the stripped end of the corresponding electric wire would not be easily pulled out of the five-sided case 14 by someone else or due to an incident (e.g., when violent shaking, swinging, or vibration takes place in the environment), so as to ensure the convenience of making an electrical connection for an electrical system and the safety and stability of the electrical connection.

Referring to FIG. 3 and FIG. 6, the busbar 40 is a rectangular member made generally of metal, such as tin-coated copper or a copper alloy, e.g., brass, phosphor bronze, or the like. The busbar 40 has a thickness T between its top side 60 and bottom side 62. The top side 60 faces the conductor at a stripped end or each electric wire inserted into the five-sided case 14, and the bottom side 62 can rest and be mounted on the horizontal foot 44. Accordingly, the busbar 40 has an entry edge 64, an exit edge 66, and at least two wire-crossing axes 68 extending from the entry edge 64 to the exit edge 66. The entry edge 64 is the edge of the busbar 40 that is first crossed by the conductor at a stripped end of an electric wire entering the five-sided case 14, and the exit edge 66 is the edge of the busbar 40 that is last crossed by the same conductor. Given the configuration of the live-sided case 14 and the position of the busbar 40 therein, each wire-crossing axis 68 is the location where the conductor at a stripped end of an electric wire inserted into the five-sided case 14 is intended to be. The busbar 40 can be rapidly mounted on, or more specifically riveted to, the horizontal foot 44 of the spring member 42 by means of rivets extending respectively through the rivet holes 41, thereby completing the assembly of the push-in connector 10.

Referring again to FIG. 6, the top side 60 of the busbar 40 is further provided with a plurality of wire-receiving pockets 74 and a plurality of corresponding wire-engaging protrusions 76. Each wire-receiving pocket 74 extends from the top side 60 downward of one of the wire-crossing axes 68, and the corresponding wire-engaging protrusion 76 extends from the top side 60 upward of the one of the wire-crossing axes 68. The wire-receiving pockets 74 and the wire-engaging protrusions 76 may be formed along with the busbar 40 while the busbar 40 is being made by stamping. Each wire-receiving pocket 74 has a depth D below the top side 60 that is at least 50% of the thickness T of the busbar 40, and each wire-receiving pocket 74 has a length L1 that is at least 30% of the distance $W_D$ between the entry edge 64 and the exit edge 66 of the busbar 40. Each wire-engaging protrusion 76 has a height H above the top side 60 that is at least 40% of the thickness of the busbar 40, and each wire-engaging protrusion 76 has a length L2 that is at least 50% of the distance $W_D$ between the entry edge 64 and the exit edge 66 of the busbar 40. Improved Busbar Patents state that when the conductor at a stripped end of an electric wire is inserted into the five-sided case 14 and pressed against the busbar 40, the foregoing configurations of the wire-receiving pockets 74 and the wire-engaging protrusions 76 provide a suitable constraint for the electrical connection between the conductor and the busbar 40. More specifically, the core technical feature of improved Busbar Patents is that the depth D of each wire-receiving pocket 74 must be sufficient to effectively enclose enough of the sides of the stranded conductor at a stripped end of an electric wire, thereby preventing the stranded conductor from splaying. Moreover, a spiral path is formed between the wire-receiving pocket 74 and the corresponding wire-engaging protrusion 76 to allow the conductor at a stripped end of an electric wire to cross the top side 60 of the busbar 40, and this structure helps the corresponding spring finger 56 to retain the conductor inside the five-sided case 14. In addition, with continued reference to FIG. 6, each wire-receiving pocket 74 has at least three pocket walls that can partially surround the conductor at a stripped end of an electric wire, aiming to effectively prevent the multiple strands of the conductor from splaying.

According to the above, although the conventional spring members and the embodiment disclosed by Improved Busbar Patents allow the conductor at a stripped end of an electric wire to be directly inserted into the housing of a push-in connector to not only rapidly establish an electrical connection between the conductor at the stripped end of the electric wire and the busbar in the housing of the push-in connector, but also not be easily retracted from inside the housing of the push-in connector so that the conductor at the stripped end of the electric wire and the busbar may stay electrically connected in a secure manner, both the conventional spring members and the spring assembly 38 in the embodiment of Improved Busbar Patents use a "one-point-and-one-line" positioning mechanism to position the conductor at a stripped end of an inserted electric wire. Therefore, whether conventional spring members have the same configuration as the spring assembly 38 in the embodiment of Improved Busbar Patents or not, referring to FIG. 7 and FIG. 8, a drastic change (e.g., a violent shaking, swinging, or vibration) in the environment where the push-in connector 10 and the electric wire W inserted therein are located may apply an environmental force to the push-in connector 10 and/or the electric wire W, such that the conductor C at the stripped end of the electric wire W and the push-in connector 10 are subjected to a torsional three R that inevitably drives the conductor C at the stripped end of the electric wire W to rotate in the push-in connector 10. As the "one-point-and-one-line" positioning mechanism is too weak to stop the conductor C at the stripped end of the electric wire W from rotating axially in the push-in connector 10, the conductor C at the stripped end of the electric wire W will keep rotating axially in the push-in connector 10 under the action of the environmental force, which may take place frequently. During the process, the edge of the free end 58 of the restraining spring finger 56 pressing on the conductor C at the stripped end of the electric wire W cuts the conductor C, e.g., stranded conductor, at the stripped end of the electric wire W in the radial direction of the electric wire. As the axial rotation of the conductor C at the stripped end of the electric wire W continues in the push-in connector 10, the cross section of the conductor C at the stripped end of the electric wire W is damaged and may end up significantly reduced, resulting in a substantial increase of the impedance of the conductor C at the stripped end of the electric wire W, causing the conductor C at the stripped end of the electric wire W, the spring assembly 38, and the five-sided case 14 highly prone to soften under high heat, undergo metal fatigue, and deform, or even worse, the spring assembly 38 may lose its intended gripping and pressing, functions such that the loosely gripped conductor C at the stripped end of the electric wire W either experiences an improper temperature rise, causes an electrical fire, or can be easily detached from the push-in connector 10 by an external three (e.g., a pulling, tugging, swinging, or other moving force), leading to malfunction, damage, or unserviceability of the electrical system involved.

Besides, referring to FIG. 9, when multiple electric wires W are placed in the spring assembly 38, the aforesaid "one-point-and-one-line" positioning mechanism cannot effectively prevent the electric wires W from being shifted horizontally to a great extent. Therefore, if the electric wires W are in a drastically changing (e.g., violently shaking, swinging, or vibrating) environment, each two adjacent electric wires W may collide with or push each other due to a shift in position, thus making a negative impact on the electronic products or equipment being connected. In view of the above, it has been an important issue in the push-in connector industry to design a novel and structurally simpler push-in connector that, referring to FIG. 7 for the ease of understanding, allows an operator to make a safer and securer electrical connection between the conductor C at a stripped end of an electric wire W and the busbar 40 in the push-in connector 10 simply by holding the electric wire W and pushing the conductor C at the stripped end of the electric W into one of the connection ports 34 of the push-in connector 10, without using any additional tool (e.g., pliers) or element (e.g., a connecting plate or insulating tape), and that prevents the conductor C at the stripped end of the electric wire W from being twisted or deformed in the push-in connector 10 so that an insulation displacement process or maintenance operation can be subsequently performed on the push-in connector 10 with ease. In terms of the time required to complete the electrical connection, it is desirable that the push-in connector 10 and the conductor C at the stripped end of the electric wire W can be electrically connected more conveniently. It is also desirable that the way of connection between the push-in connector 10 and the conductor C at the stripped end of the electric wire W allows the conductor C at the stripped end of the electric wire W to stay entirely in the insulated environment provided by the push-in connector 10 and be completely insulated from the surroundings, so as to enable more satisfactory, stable, and safer transmission of electrical signals between the electric wire W and the busbar 40, to effectively prevent the aforementioned fire accident, and to ensure that the electric equipment and system involved will not be damaged or malfunction. The designing of such a novel push-in connector is therefore one of the issues addressed by the present disclosure.

SUMMARY

In view of the aforesaid issues of the conventional push-in connectors, based on more than forty years of practical experience in the design and manufacture of various connectors, and repeated designing, manufacturing, testing and process improving, the present disclosure provides a two-points-and-one-line push-in terminal capable of secure positioning and a connector using the same, which not only increase the convenience of making an electrical connection through a push-in connector and the safety of the electrical connection, but also effectively ensure the service lives, as well as the safety and stability of electrical signal transmission, of the electrical system involved and of the related electrical or electronic equipment in a drastically changing (e.g., violently shaking, swinging, or vibrating) environment.

One aspect of the present disclosure is directed to a two-points-and-one-line push-in terminal capable of secure positioning. The push-in terminal includes a terminal body and an electrically conductive busbar. The terminal body is formed by stamping and bending an elastic metal plate, has a U-shaped longitudinal cross section, and includes, sequentially in a front-to-rear direction, at least one front upstanding insertion leg, a horizontal joining foot, and at least one rear upstanding insertion leg. The at least one front upstanding insertion leg is jointed to the front end of the horizontal joining foot, and formed with a first bending line at the joint between the front upstanding insertion leg and the horizontal joining foot and at least one slit that divides the front upstanding insertion leg into at least two independent sections. Each independent section has a first U-shaped slit defining a front pressing frame and a front pressing spring finger having a free end and an opposite end integrally connected to the independent section. The at least one slit extends downward from a top edge al the front upstanding insertion leg, and terminates at a position adjacent to the first bending line. The at least one rear upstanding insertion leg is jointed to the rear end of the horizontal joining foot, and formed with a second bending line at the joint between the rear upstanding insertion leg and the horizontal joining foot and at least one slit that divides the rear upstanding insertion leg into at least two independent sections. Each independent section has a second U-shaped slit defining a rear pressing frame and a rear pressing spring finger having a free end and an opposite end integrally connected to the independent section. The at least one slit extends down yard from a top edge of the rear upstanding insertion leg, and terminates at a position adjacent to the second bending line. The first U-shaped slit and the corresponding second U-shaped slit lie on the same insertion axis. The front pressing frame and the rear pressing frame that lie on the same insertion axis correspond to each other. The free ends of the front pressing spring finger and the rear pressing spring finger extend slantingly toward a rear end of the insertion axis, and can abut against a conductor at a stripped end of an electric wire. The electrically conductive busbar can be mounted on a top surface of the horizontal joining foot and conduct the horizontal joining foot and the terminal body with a power source. More specifically, the bottom surface of the busbar can be mounted on, or connected to, the top surface of the horizontal joining loot in order to bring the horizontal joining thot and the terminal body into conduction with the power source. The busbar has an abutting surface formed on a top surface thereof that faces the insertion axes and can abut against the conductor, grip, along with the free ends of the front pressing spring finger and the rear pressing spring finger, the conductor in the push-in terminal, and restrain, along with the free ends of the front pressing spring finger and the rear pressing spring finger, the conductor in the corresponding front pressing frame and rear pressing frame.

Once the conductor has passed sequentially through a corresponding pair of the first and second U-shaped slits along the corresponding insertion axis, the conductor will abut securely against the free ends, that is, the "two points" according to the present disclosure, of the corresponding pressing spring fingers and a top portion of the abutting surface, that is, the "one line" according to the present disclosure, and thus not only be securely gripped at a predetermined correct insertion position by the corresponding pressing spring fingers and the abutting surface, but also be restrained in the corresponding front and rear pressing frames. The conductor at the stripped end of the electric wire, therefore, can be mounted rapidly, conveniently, precisely, safely, and securely to the push-in terminal in the "two-points-and-one-line" mechanism and form a safe and secure electrically conductive relationship with the busbar through the push-in terminal. The conductor at the stripped end of the electric wire and the push-in terminal will be kept from such abnormalities as being shifted laterally twisting detrimentally, or getting loose with respect to each other or separating from each other; can provide electrical signal transmission stably and safely; and can effectively prevent fire accidents and malfunctions attributable to the aforesaid abnormalities.

Another aspect of the present disclosure is directed to a two-points-and-one-line push-in connector capable of secure positioning. The push-in connector includes a terminal body, an electrically conductive busbar and a housing. The terminal body is formed by stamping and bending an elastic metal plate, has a U-shaped longitudinal cross section, and includes, sequentially in a front-to-rear direction, at least one front upstanding insertion leg a horizontal joining foot, and at least one rear upstanding insertion leg. The at least one front upstanding insertion leg is jointed to the front end of the horizontal joining foot, and formed with a first bending line at the joint between the front upstanding insertion leg and the horizontal joining foot and at least one slit that divides the front upstanding insertion leg into at least two independent sections. Each independent section has a first U-shaped slit defining a front pressing frame and a front pressing spring finger having a free end and an opposite end integrally connected to the independent section. The at least one slit extends downward from a top edge of the front upstanding insertion leg, and terminates at a position adjacent to the first bending line. The at least one rear upstanding insertion leg is jointed to the rear end of the horizontal joining foot, and formed with a second bending line at the joint between the rear upstanding insertion leg and the horizontal joining foot and at least slit that divides the rear upstanding insertion leg into at least two independent sections, Each independent section has a second U-shaped slit defining a rear pressing frame and a rear pressing spring finger having a free end and an opposite end integrally connected to the independent section. The at least one slit extends downward from a top edge of the rear upstanding insertion leg, and terminates at a position adjacent to the second bending line. The first U-shaped slit and the corresponding second U-shaped slit lie on the same insertion axis. The front pressing frame and the rear pressing frame that lie on the same insertion axis correspond to each other. The free ends of the front pressing spring finger and the rear pressing spring finger extend slantingly toward a rear end of the insertion axis, and can abut against a conductor at a stripped end of an electric wire. The electrically conductive busbar can be mounted on a top surface of the horizontal joining foot and conduct the horizontal joining foot and the terminal body with a power source. More specifically, the bottom surface of the busbar can be mounted on, or connected to, the top surface of the horizontal joining foot in order to bring the horizontal joining foot and the terminal body into conduction with the power source. The busbar has an abutting surface formed on a top surface thereof that faces the insertion axes and can abut against the conductor, and grip, along with the free ends of the front pressing spring finger and the rear pressing spring finger, the conductor in the push-in terminal. A configuration collectively formed by the first U-shaped slit, the second U-shaped slit, the front pressing spring finger, the rear pressing spring finger, the front pressing frame and the rear pressing frame corresponds to or matches a cross-sectional configuration of the conductor, so that once the conductor has passed sequentially through a corresponding pair of the first and second U-shaped slits along the corresponding insertion axis, the conductor will abut securely against the free ends, that is, the "two points" according to the present disclosure, of the corresponding pressing spring fingers and a top portion of the abutting surface, that is, the "one line" according to the present disclosure, for the conductor at the stripped end of the electric wire to be mounted rapidly, conveniently, precisely, safely, and securely to the push-in terminal in the "two-points-and-one-line" mechanism and form an electrically conductive relationship with the busbar through the terminal body. The conductor at the stripped end of the electric wire and the terminal body will be kept from such abnormalities as being shifted laterally, twisting detrimentally, or getting loose with respect to each other or separating from each other, or fire accidents and malfunctions attributable to the aforesaid abnormalities. The insulative housing includes a hollow interior for mounting the terminal body therein and having a configuration matching a configuration of the terminal body, and at least two connection ports, each formed at a front side of the housing, in communication with the hollow interior, and can be inserted with the conductor. More specifically, the configuration of the hollow interior can match that of the terminal body so that the terminal body can be mounted securely in the hollow interior. The connection ports are formed at the front side of the housing and are in communication with the hollow interior so that the conductor at a stripped end of an electric wire can be inserted into the hollow interior through any of the connection ports, passed through the corresponding U-shaped slits along the corresponding insertion axis, held at a predetermined correct insertion position by the corresponding pressing spring fingers, pressed firmly against the abutting surface of the busbar, and restrained in the corresponding front and rear pressing frames. It is thus ensured that thanks to the "two-points-and-one-line" positioning mechanism of the present disclosure, the conductor at a stripped end of an electric wire inserted into the hollow interior will not be twisted or damaged in the hollow interior due to an abruptly changing environment, and that the conductor at a stripped end of an electric wire can always be rapidly inserted to a correct insertion position to transmit electrical signals stably and safely.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION

To facilitate understanding of the difference between the "one-point-and-one-line" positioning mechanism adopted by the conventional spring members and the embodiments of Improved Busbar Patents and the "two-points-and-one-line" positioning mechanism according to the present disclosure, the "one-point-and-one-line" positioning mechanism is first described as follows, with the embodiments of Improved Busbar Patents being taken as examples, so that the novelty/distinctness and the utility of the "two-points-and-one-line" positioning mechanism according to the present disclosure can be more clearly presented.

Figure 7:
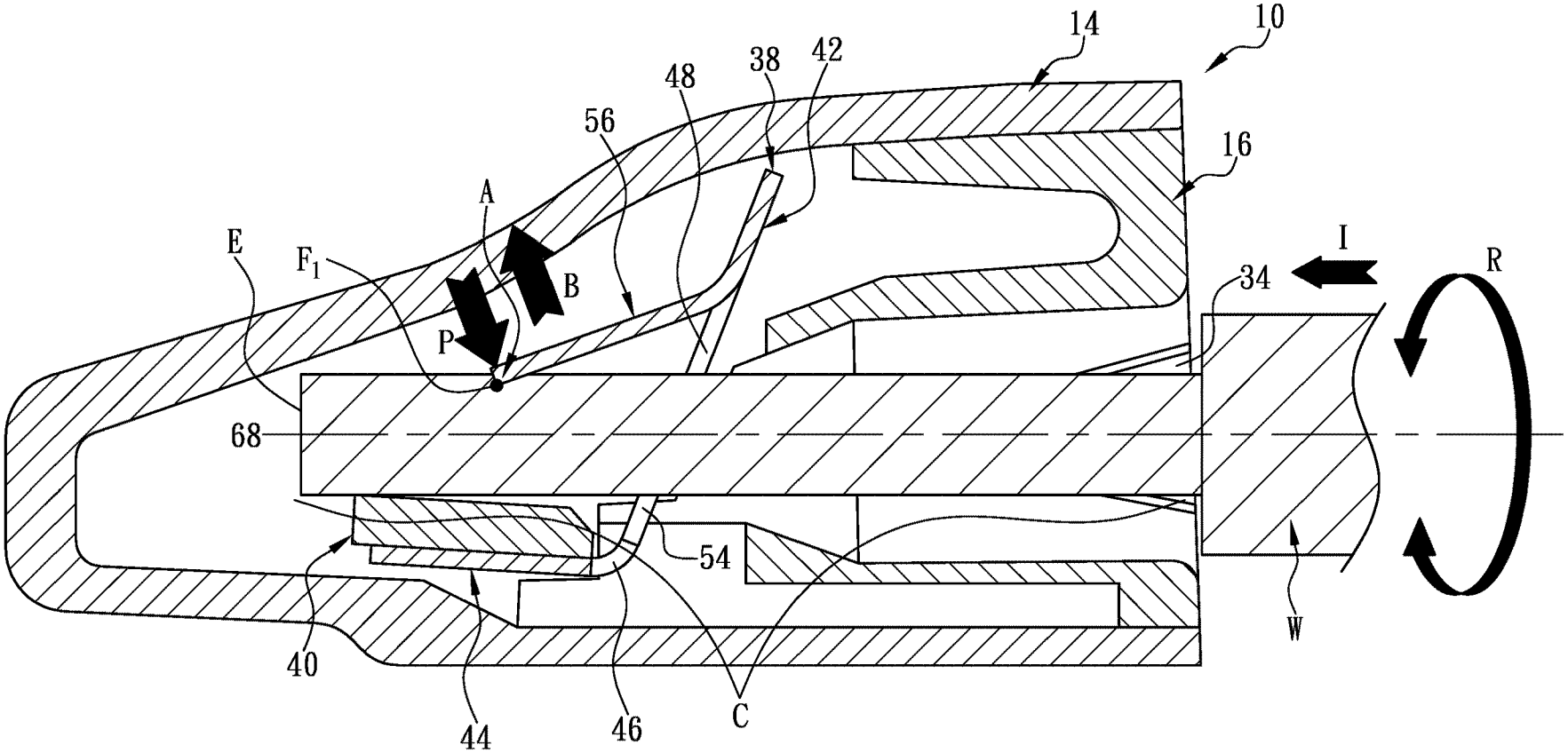
FIG. 7 (Prior Art)
FIG. 7 is a longitudinal sectional view of the conventional push-in connector being connected with an electric wire.
Figure 8:
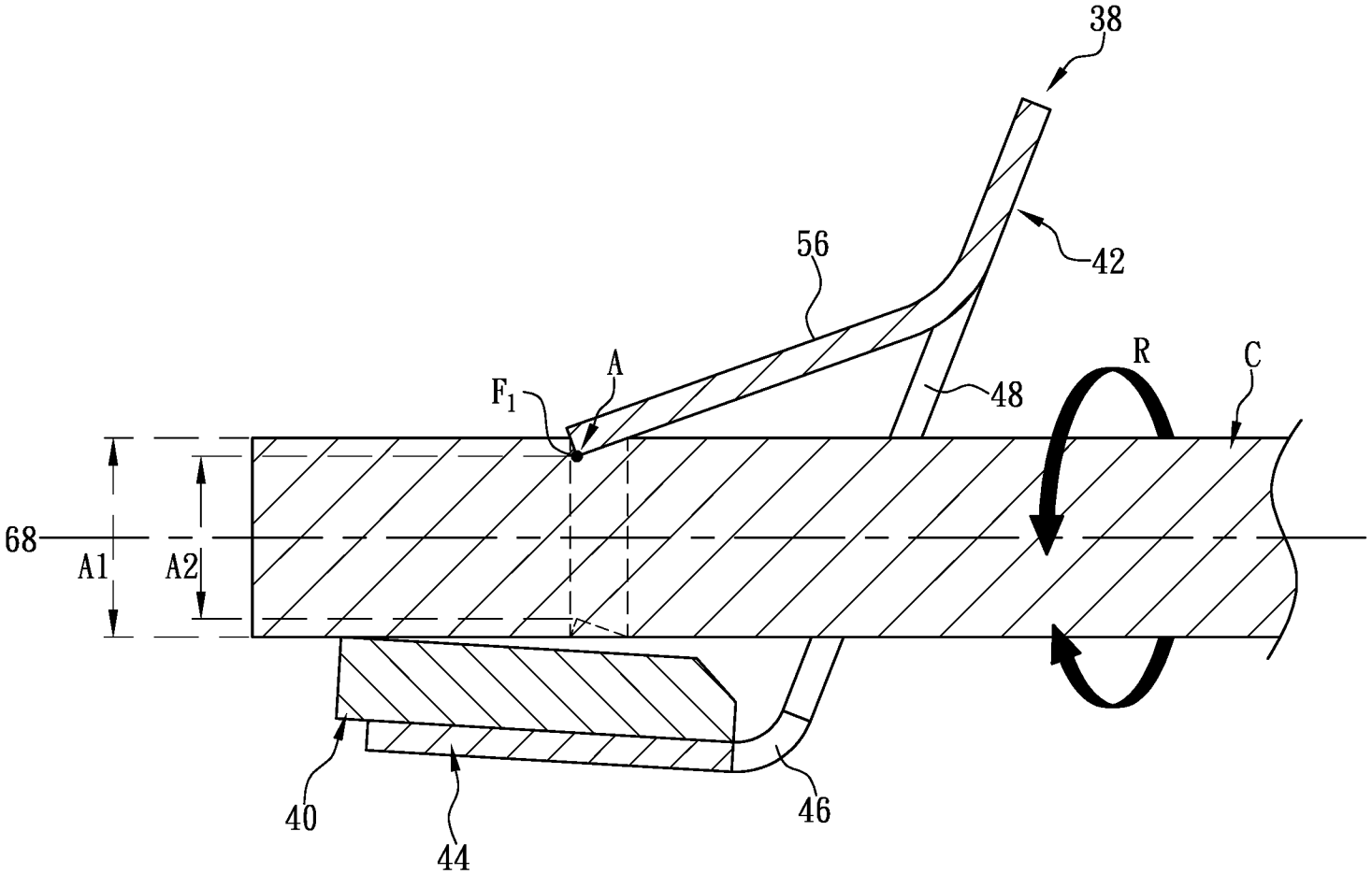
FIG. 8 (Prior Art)
FIG. 8 is a longitudinal sectional view of the spring assembly of the conventional push-in connector being connected with an electric wire.
Figure 9:
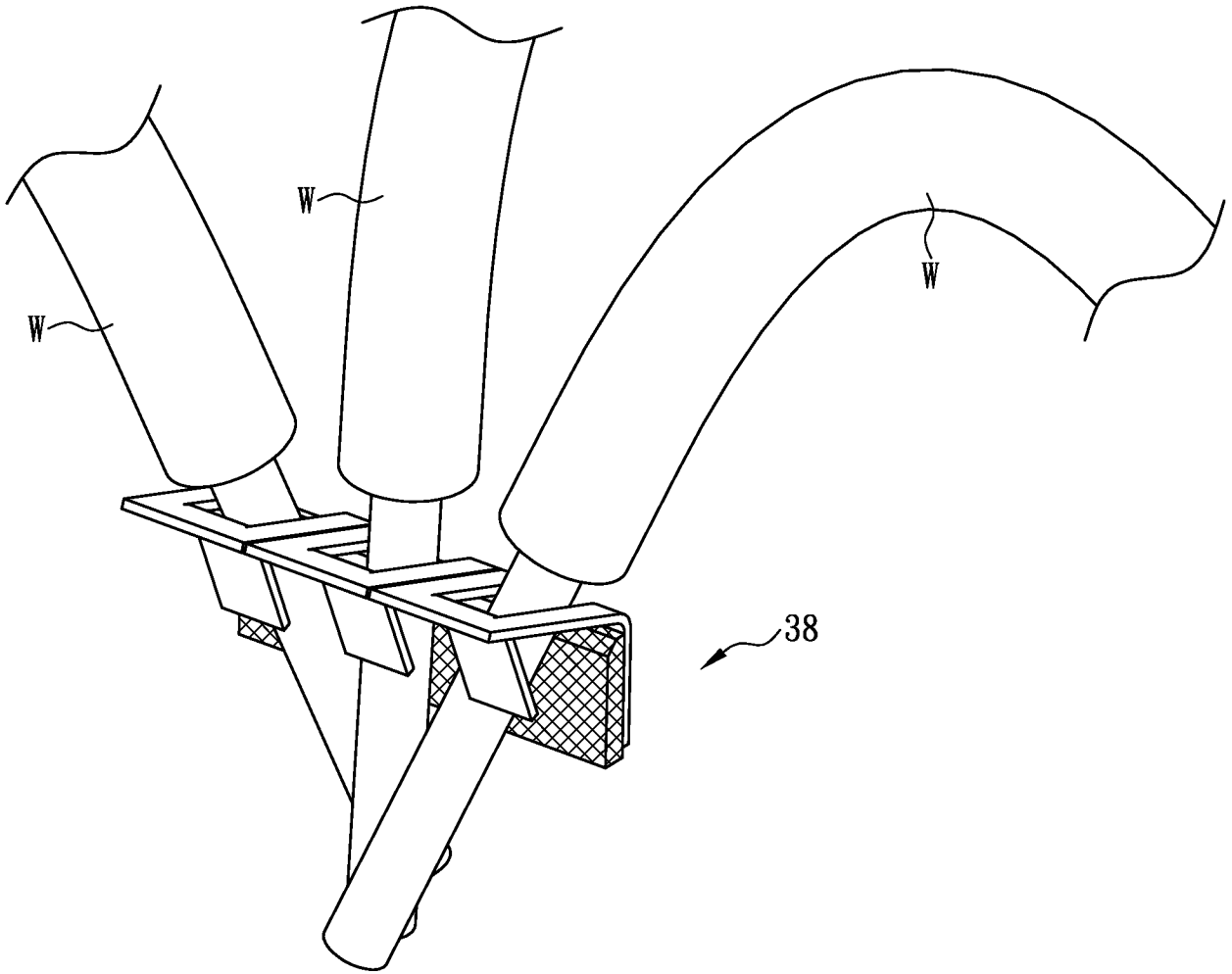
FIG. 9 (Prior Art)
FIG. 9 is a perspective view showing a plurality of electric wires shifted in place in the conventional push-in connector.
Figure 10:
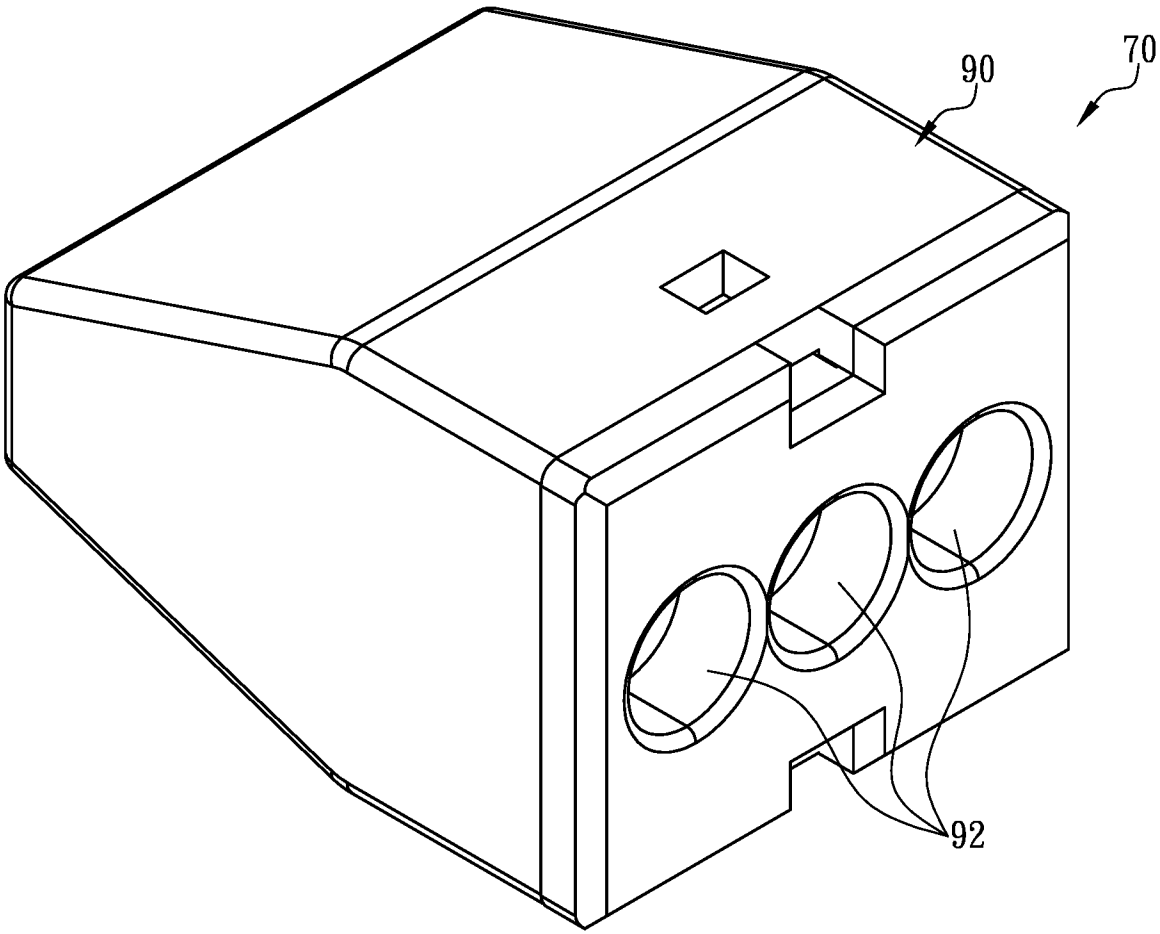
FIG. 10 is a front perspective vie of a push-in connector according to certain embodiments of the present disclosure.

Referring to FIG. 7, the reason that the conductor C at a stripped end of an electric wire W inserted into the push-in connector 10 can be damaged in a drastically changing (e.g., violently shaking, swinging, or vibrating) environment after being passed through one of the connection ports 34 and connected to and held in place by the spring assembly 38 would be further elaborated infra. As stated above, the damage may result in a substantial increase of the impedance of the conductor C at the stripped end of the electric wire W, and the increased impedance may in turn lead to a high temperature that causes the conductor C at the stripped end of the electric wire W, the spring assembly 38, and the live-sided case 14 to soften, undergo metal fatigue, and deform. Even worse, the spring assembly 38 may lose its intended gripping and pressing functions as a result, and in that case, the loosely gripped conductor C at the stripped end of the electric wire W either may experience an improper temperature rise, if not causing an electrical fire, or can be easily detached from the push-in connector 10 by an external force (e.g., a pulling, tugging, swinging, or other moving force) such that the electrical system involved malfunctions, gets damaged, or becomes unserviceable.

Figure 1:
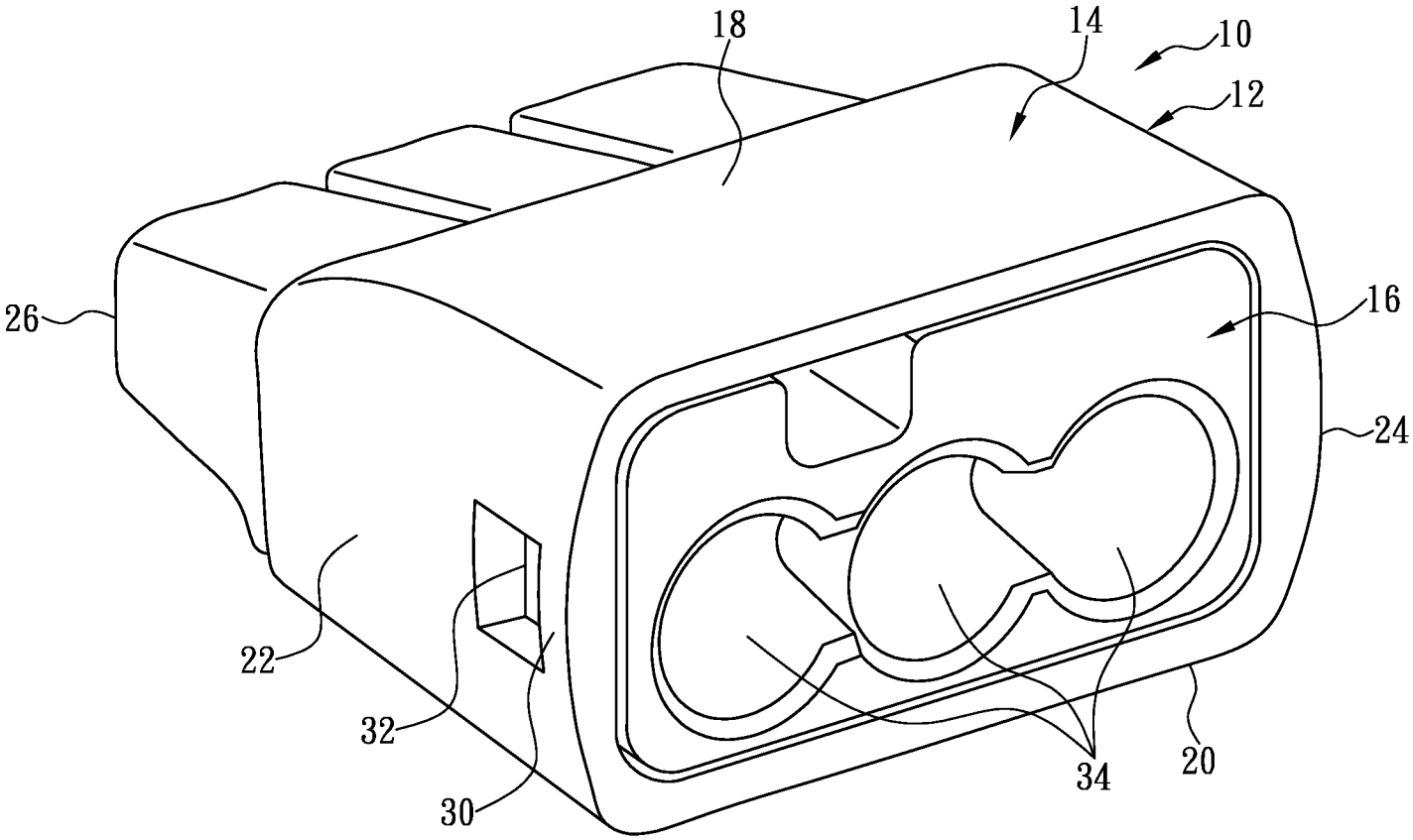
FIG. 1 (Prior Art)
FIG. 1 is a front perspective view of a conventional push-in connector.
Figure 2:
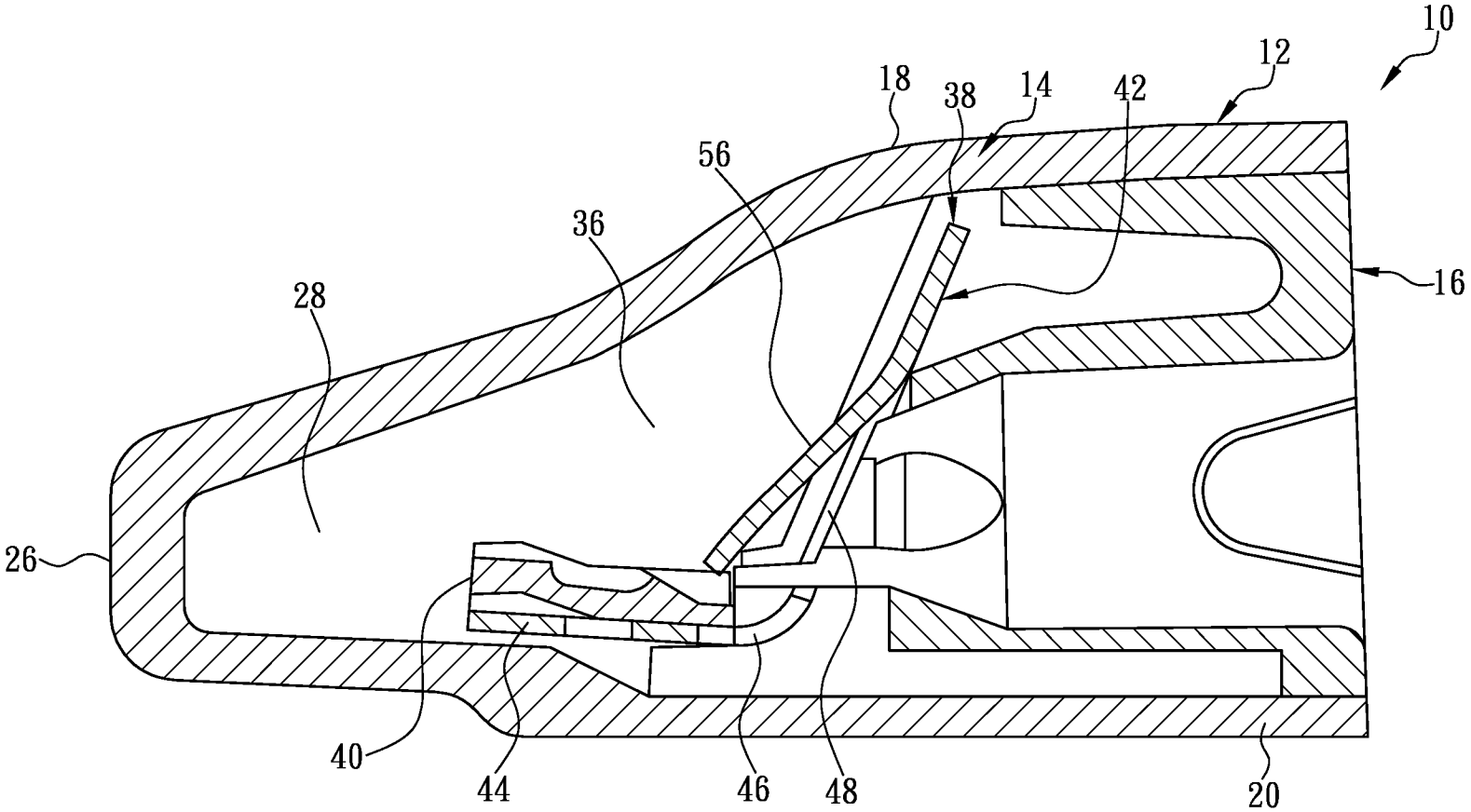
FIG. 2 (Prior Art)
FIG. 2 is a longitudinal sectional view of the conventional push-in connector.
Figure 3:
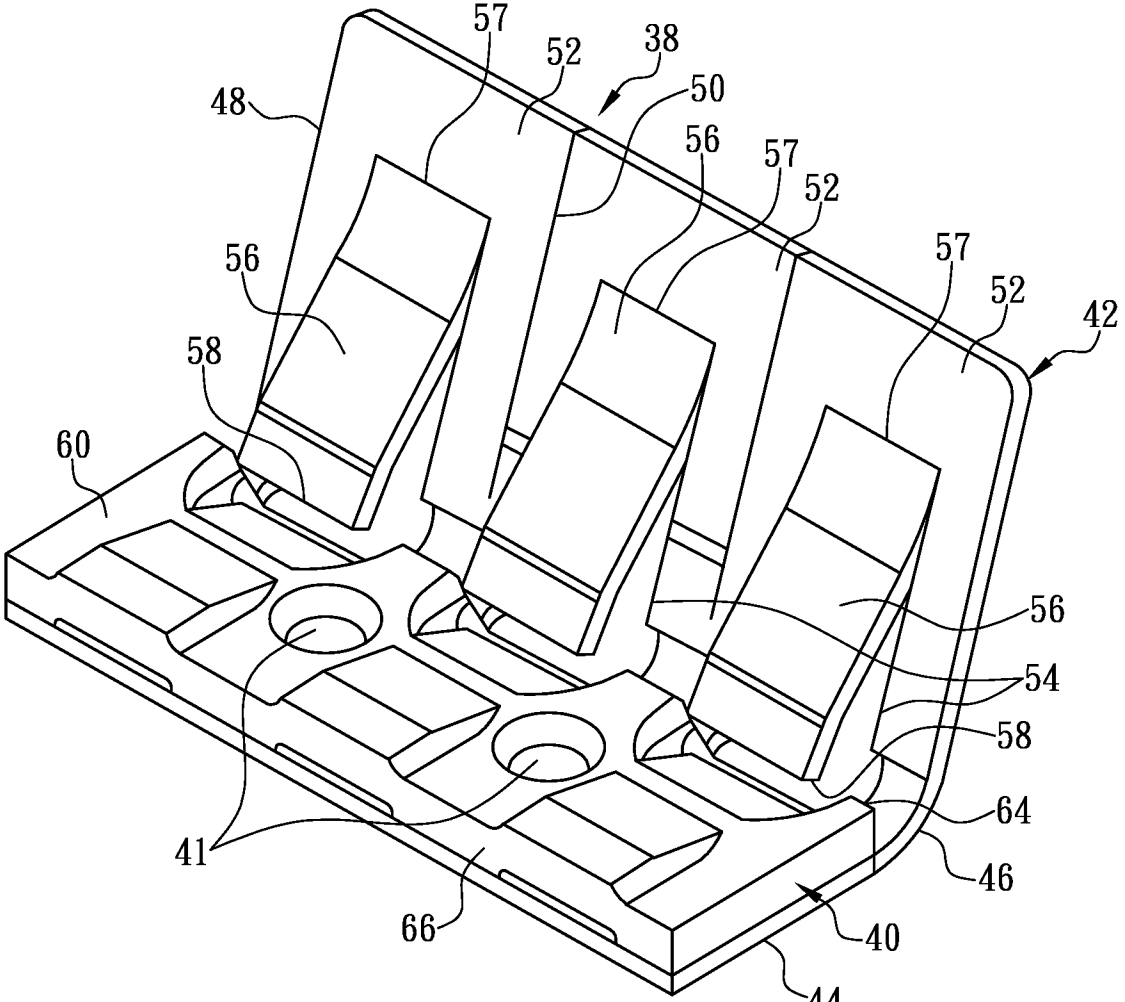
FIG. 3 (Prior Art)
FIG. 3 is a rear perspective view of the spring assembly of the conventional push-in connector.
Figure 4:
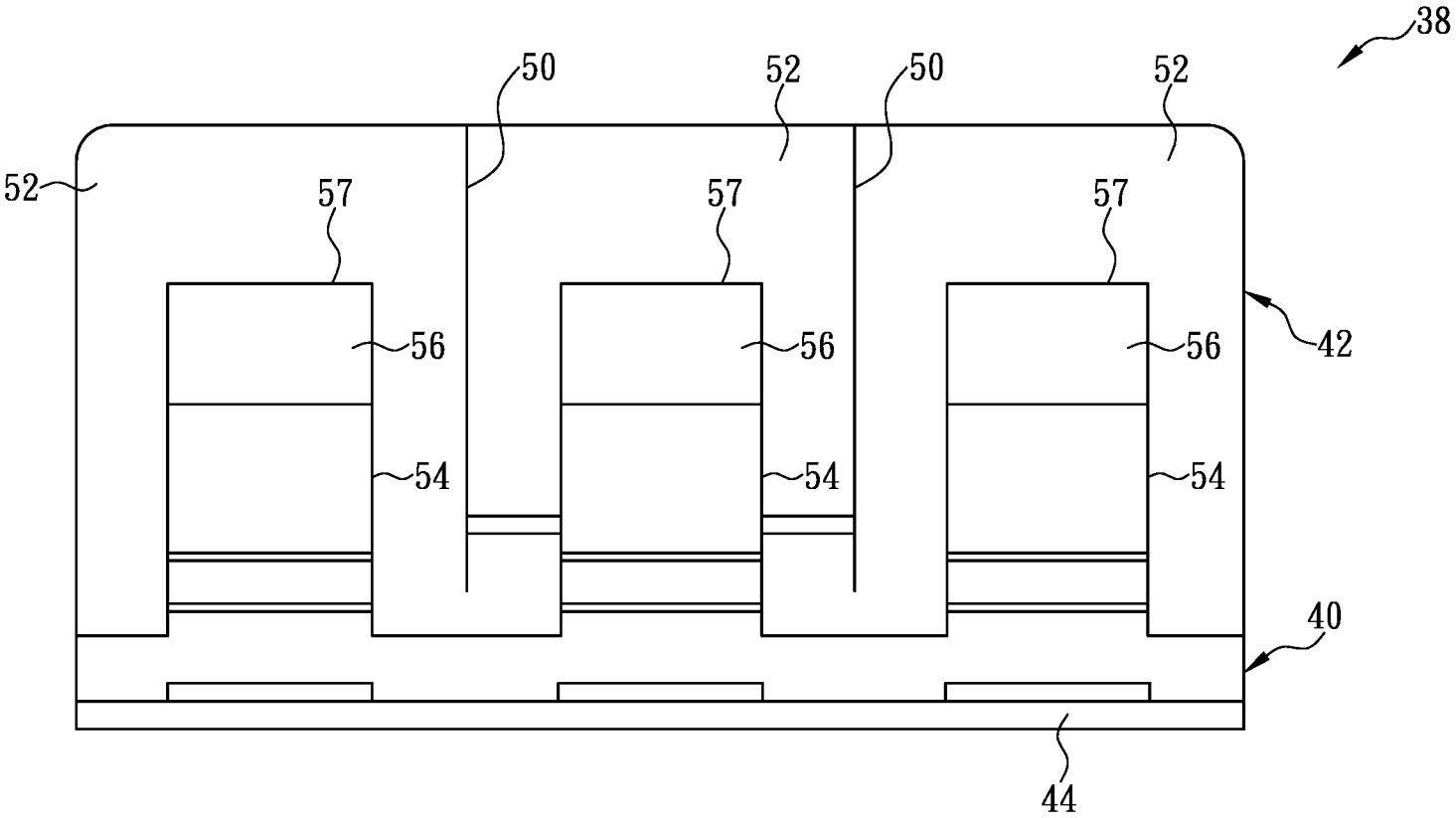
FIG. 4 (Prior Art)
FIG. 4 is a rear view of the spring assembly of the conventional push-in connector.
Figure 5:
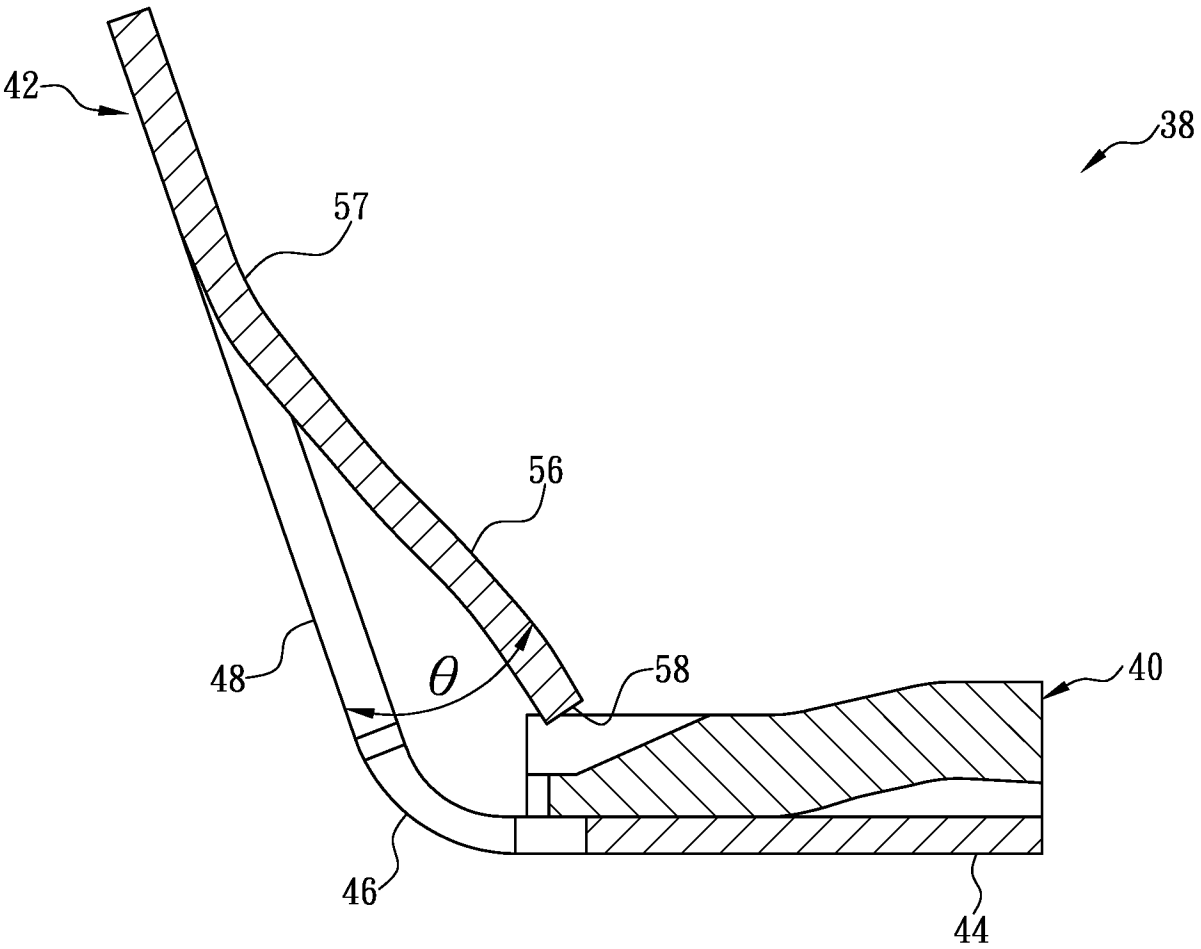
FIG. 5 (Prior Art)
FIG. 5 is a longitudinal sectional of the spring assembly of the conventional push-in connector.
Figure 6:
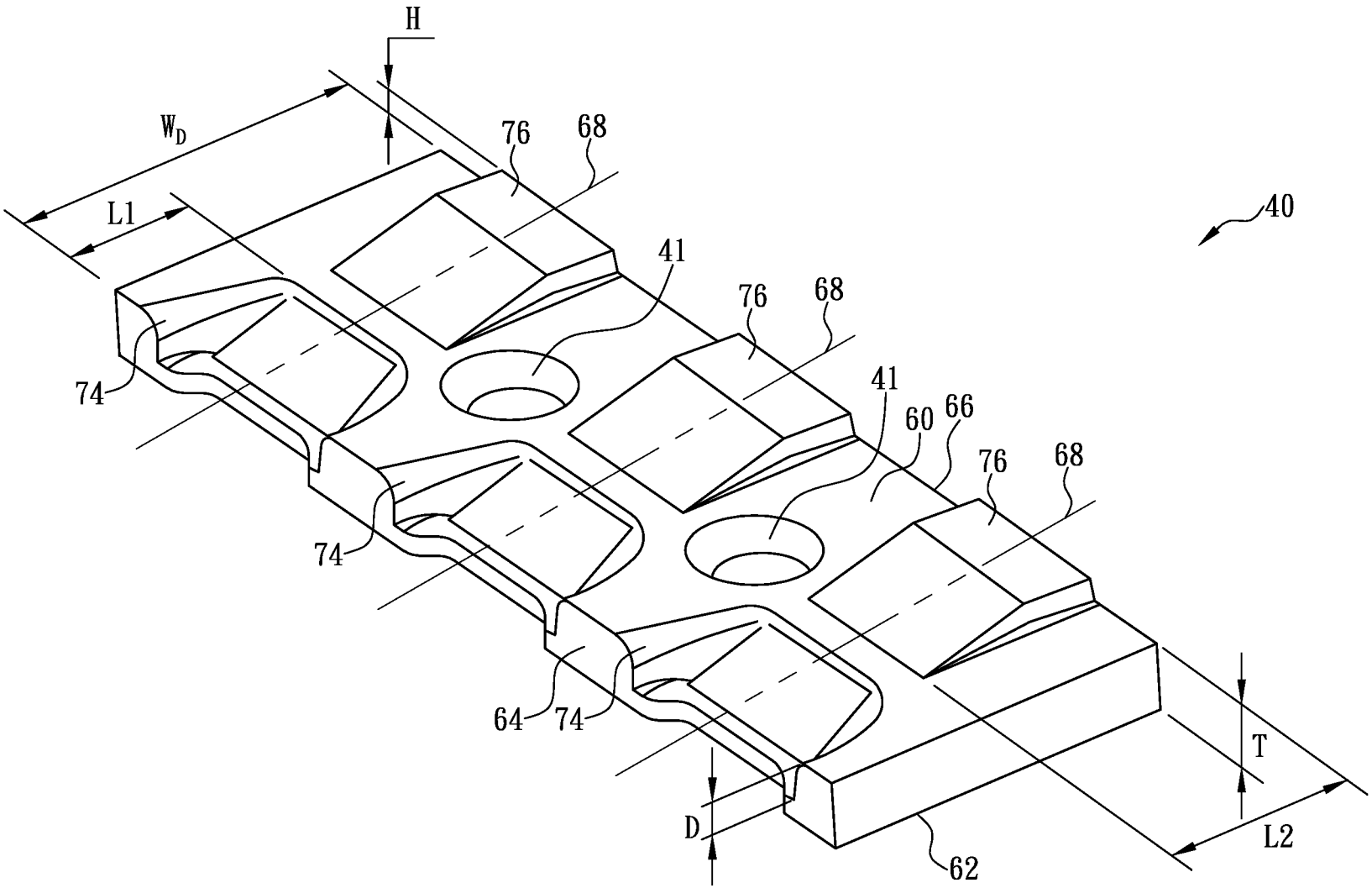
FIG. 6 (Prior Art)
FIG. 6 is a front perspective view of the busbar of the conventional push-in connector.

Specifically, the spring assembly 38 used in the embodiment of Improved Busbar Patents, as well as the conventional spring members described supra, has the basic configuration shown in FIG. 2 and FIG. 3 and is composed of the spring member 42 and the busbar 40 fixed on the spring member 42. The spring member 42 is formed by stamping and bending an elastic metal plate and includes the upstanding leg 48 and the horizontal foot 44. The joint between the upstanding leg 48 and the horizontal foot 44 forms the bending line 46. The horizontal foot 44 is electrically connected to the busbar 40 in order to receive electricity from the busbar 40. Referring again to FIG. 4, FIG. 5, and FIG. 6, the two slits 50 are formed in the elastic metal plate while the elastic metal plate is stamped to form the upstanding leg 48. The slits 50 divide the elastic metal plate into the three independent sections 52. Each slit 50 extends downward from the top edge of the upstanding leg 48 and terminates at a position adjacent to the bending line 46. Each independent section 52 further includes the U-shaped slit 54 formed by stamping, and each U-shaped slit 54 defines the restraining spring finger 56 of the corresponding independent section 52. Each restraining spring finger 56 is integrally connected to the corresponding independent section 52 at one end 57 and has the opposite free end 58 extending slantingly into the hollow interior 28 of the five-sided case 14.

Referring again to FIG. 4 and FIG. 5, the end 58 (i.e., free end 58) of each restraining spring finger 56 is curved toward the rear side of the hollow interior 28 and extends toward the horizontal foot 44 such that the free end 58 and the remainder of the independent section 52 form the included angle θ, at which the restraining spring finger 56 can produce the optimal gripping and pressing force to thereby grip and secure at the correct position, the conductor C at a stripped end of an electric wire W inserted into the push-in connector 10, with the conductor C at the stripped end of the electric wire W pressed securely against the busbar 40 to establish a stable electrically conductive relationship between the conductor C at the stripped end of the electric wire W and the busbar 40.

Referring again to FIG. 7, when an operator inserts the conductor C at a stripped end of an electric wire W into one of the connection ports 34 of the push-in connector 10, the conductor C at the stripped end of the electric wire W extends into the hollow interior 28 of the push-in connector 10 until the terminal end E of the conductor C at the stripped end of the electric wire W is pressed against the outer side of the corresponding restraining spring finger 56. After that, the operator only has to apply a pushing force I toward the rear side of the push-in connector 10, thereby pushing the conductor C at the stripped end of the electric wire W rearward, and the corresponding restraining spring finger 56 will be bent in a direction away from the conductor C at the stripped end of the electric wire W (as indicated by the arrow B), allowing the terminal end E of the conductor C at the stripped end of the electric wire W to move past the corresponding U-shaped slit 54. Once the conductor C at the stripped end of the electric wire W touches the busbar 40, and the terminal end E of the conductor C stops applying the pushing force I to the outer side of the corresponding restraining spring finger 56, the corresponding restraining spring finger 56 is driven by its elastic restoring force and turned toward the conductor C at the stripped end of the electric wire W (as indicated by the arrow P). In consequence, the free end 58 of the corresponding restraining spring finger 56 is pressed firmly against the conductor C at the stripped end of the electric wire W, and the conductor C at the stripped end of the electric wire W is pressed tightly on the busbar 40.

Thus, with the free end 58 of the corresponding restraining spring finger 56 pressed at a positioning point F1, that is, at "one point", on the conductor C at the stripped end of the electric wire W, the conductor C at the stripped end of the electric wire W is precisely positioned on the corresponding wire-crossing axis 68, that is, on the "one line", forming, a "one-point-and-one-line" positioning mechanism, which aims to not only allow the conductor C at the stripped end of the electric wire W to be tightly pressed on and form a secure electrical connection with the busbar 40, but also to effectively prevent the conductor at the stripped end of the electric wire W from separating from the free end 58 of the corresponding restraining spring finger 56 easily, and hence from being pulled out of the five-sided case 14 readily by someone else or due to an incident (e.g., when violent shaking, swinging, or vibration takes place in the environment), so as to increase the convenience of making an electrical connection for an electrical system and the safety and stability of the electrical connection made.

However, whether the conventional spring members have the same configurational details as the spring assembly 38 in the embodiment of Improved Busbar Patents, a drastic change violent shaking, swinging, or vibration) in the environment where the push-in connector 10 and the electric wire W inserted therein are located may generate an environmental force that subjects the conductor C at the stripped end of the electric wire W and the push-in connector 10 to a torsional force (as indicated by the arrow R) that inevitably drives the conductor C at the stripped end of the electric wire W to rotate in the push-in connector 10. As the "one-point-and-one-line" positioning mechanism is too weak to stop the conductor C at the stripped end of the electric wire W from rotating in the push-in connector 10 along the corresponding wire-crossing axis 68, the conductor C at the stripped end of the electric wire W will keep rotating axially in the push-in connector 10. Consequently, the conductor C, e.g., stranded conductor, at the stripped end of the electric wire W is radially cut by an edge A of the free end 58 of the restraining spring finger 56 that presses on the conductor C at the stripped end of the electric wire W. As the axial rotation of the conductor C at the stripped end of the electric wire W continues in the push-in connector 10, the cross-sectional area of the conductor C at the stripped end of the electric wire W is bound to be reduced substantially in the end, e.g., from the originally designed initial cross-sectional area A1 to the damaged final cross-sectional area A2 (i.e., A2<A1), resulting in a substantial increase of the impedance of the conductor C at the stripped end of the electric wire W. Should this happen, the conductor C at the stripped end of the electric wire W, the spring, assembly 38, and the five-sided case 14 are very likely to soften, undergo metal fatigue, and deform under high heat, or even worse, the spring assembly 38 may lose its intended gripping and pressing functions such that the loosely gripped conductor C at the stripped end of the electric wire W either experiences an improper temperature rise, if not causing an electrical fire, or can be easily detached from the push-in connector 10 by an external force (e.g., a pulling, tugging, swinging, or other moving force), leading to malfunction, damage, or unserviceability of the electrical system involved.

In light of the aforesaid issues that have long been associated with the "one-point-and-one-line" positioning mechanism used by the conventional spring members and the embodiment of Improved Busbar Patents, based on more than forty years of practical experience in the development, design, and manufacture of various electrical or electronic connectors, and repeated designing, manufacturing, testing and process improving, the present disclosure provides a two-points-and-one-line push-in terminal capable of secure positioning and a connector using the same. The push-in terminal and the connector using the same enable easier and more rapid assembly, and prevent the conductor at a stripped end of an electric wire inserted into a push-in connector from axial rotation in the push-in connector when in a drastically changing (e.g., violently shaking, swinging, or vibrating) environment, thereby ensuring that the push-in connector and the conductor at the stripped end of the electric wire will stay intact, that an electrical connection can always be conveniently made for an electrical system through the push-in connector, and that the electrical connection made will remain safe and stable.

Figure 11:
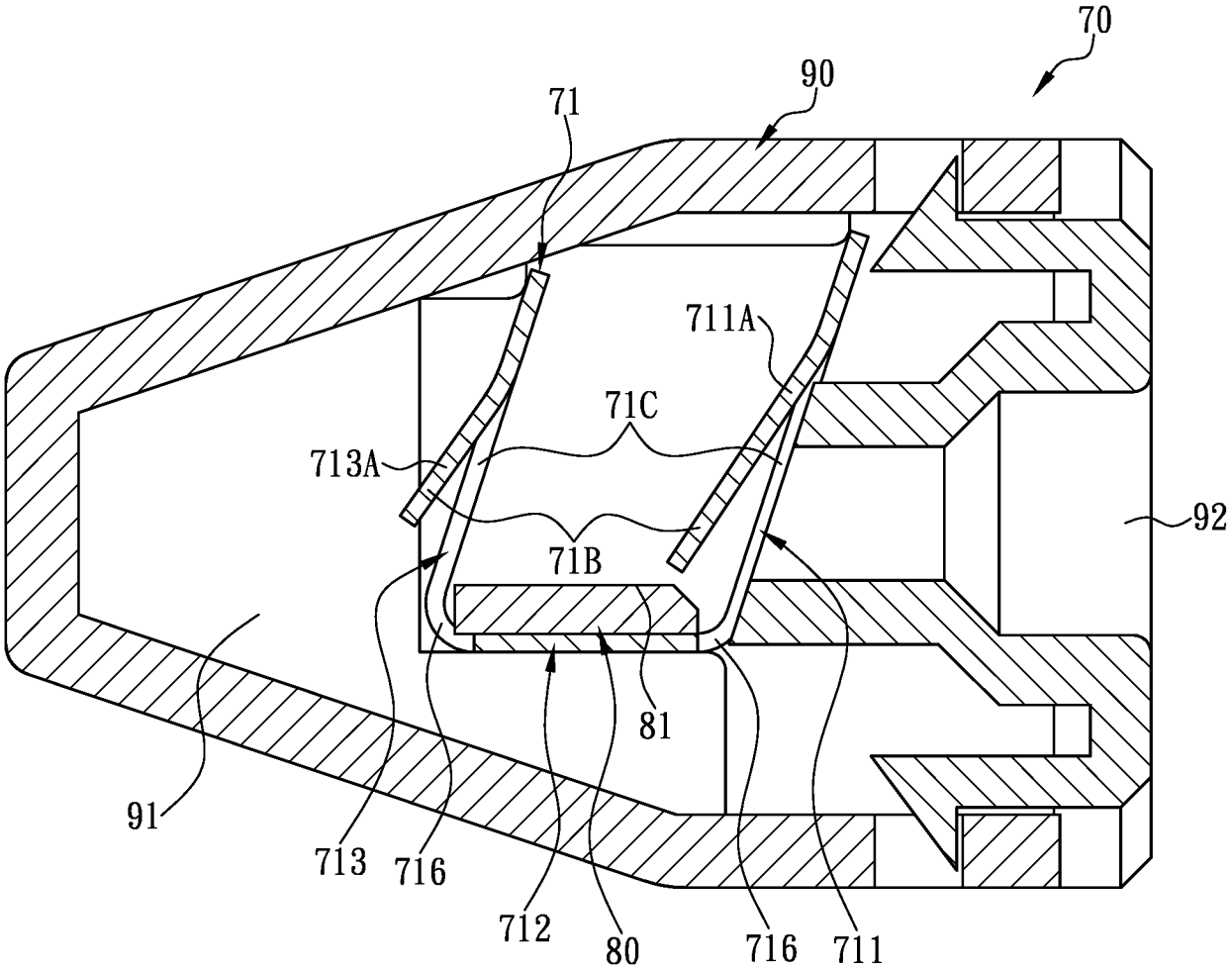
FIG. 11 is a longitudinal sectional view of the push-in connector according to certain embodiments of the present disclosure.
Figure 12:
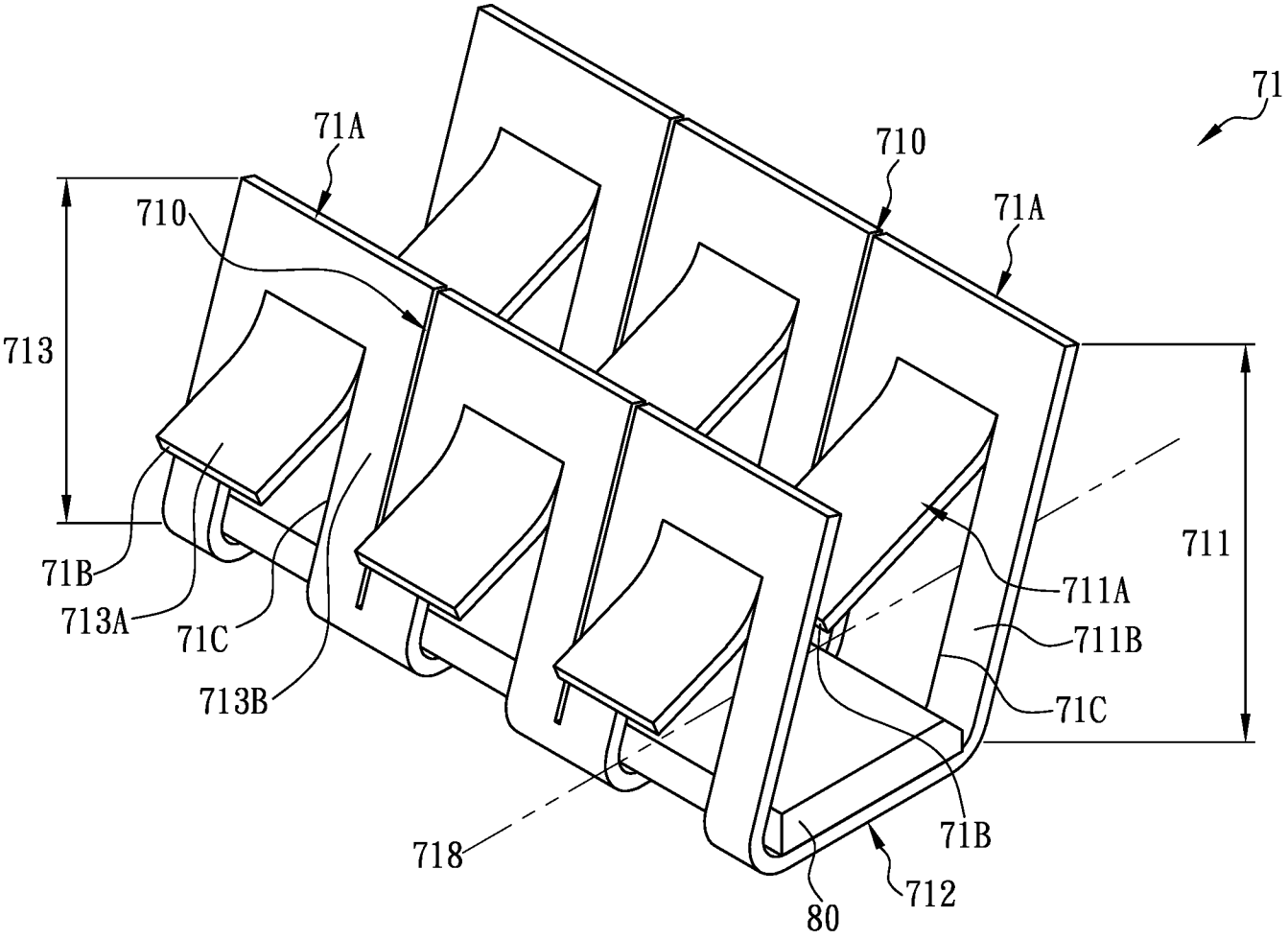
FIG. 12 is a rear perspective view of the terminal body of the push-in connector according to certain embodiments of the present disclosure.
Figure 13:
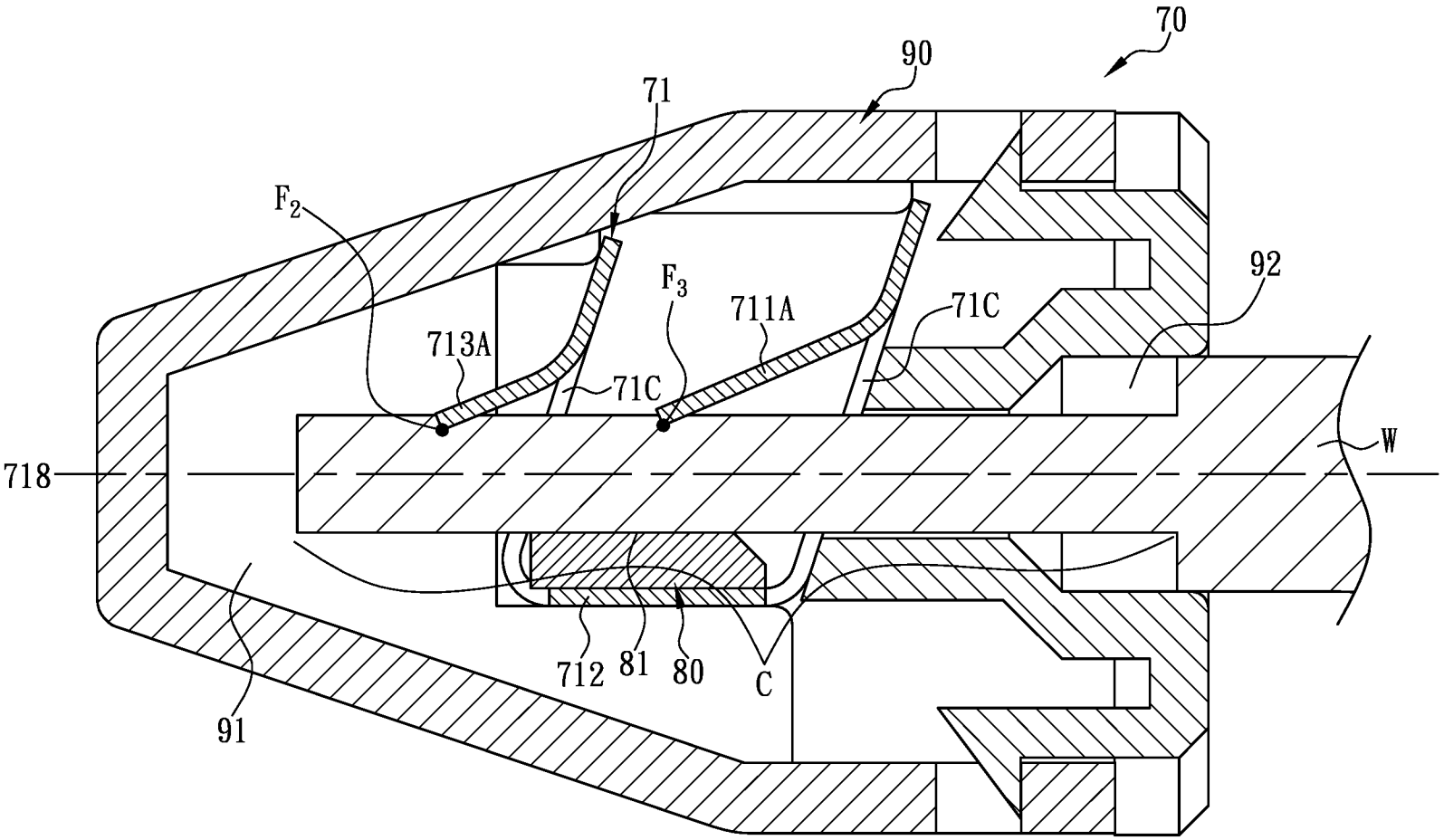
FIG. 13 is a longitudinal sectional view of the push-in connector according to certain embodiments of the present disclosure being connected with an electric wire.

Referring to FIG. 11 and FIG. 12, in certain embodiments, a two-points-and-one-line push-in terminal capable of secure positioning, includes a terminal body 71 and a busbar 80. As shown in FIG. 12, the terminal body 71, which is formed by stamping and bending an elastic metal plate, has a U-shaped longitudinal cross section and includes, sequentially in a front-to-rear direction, at least one front upstanding insertion leg 711, a horizontal joining foot 712, and at least one rear upstanding insertion leg 713. The upstanding insertion legs 711 and 713 are joined to the front end and the rear end of the horizontal joining foot 712 respectively, and each of the joints between the upstanding insertion leg 711 and the horizontal joining foot 712 and between the rear upstanding insertion leg 713 and the horizontal joining foot 712 forms a bending line 716. With continued reference to FIG. 12, at least two slits 710 are formed in the elastic metal plate while the elastic metal plate is stamped to form the front upstanding insertion leg 711 and the rear upstanding insertion leg 713, which can divide the elastic metal plate into at least four independent sections 71A. Referring to FIG. 11 to FIG. 13, the elastic metal plate is formed with four slits 710 that divide the elastic metal plate into six independent sections 71A. The number of the slits 710 and the number of the independent sections 71A, however, are not limited to those disclosed herein and may be increased or decreased according to practical needs.

Each slit 710 extends downward from the top edge of the corresponding upstanding insertion leg 711 or 713 and terminates at a position adjacent to the corresponding bending line 716. Each independent section 71A further includes a U-shaped slit 71C formed by stamping. The U-shaped slits 71C are respectively formed in each of the front upstanding insertion leg 711 and the rear upstanding insertion leg 713. The U-shaped slits 71C formed respectively in the front upstanding insertion leg 711 and the rear upstanding insertion leg 713 correspond in pairs. The U-shaped slits 71C corresponding to each other lie on the same insertion axis 718, and define a front pressing spring finger 711A and a front pressing frame 711B of the corresponding independent section 71A of the front upstanding insertion leg 711 and a rear pressing spring finger 713A and a rear pressing frame 713B. Each of the front pressing spring finger 711A and the rear pressing spring finger 713A has one end integrally connected to the corresponding independent section 71A and an opposite free end 71B extending slantingly toward the rear end of the corresponding insertion axis 718. Moreover, the front and rear pressing frames 711B and 713B lying respectively on the same insertion axes 718 correspond to each other.

Figure 14:
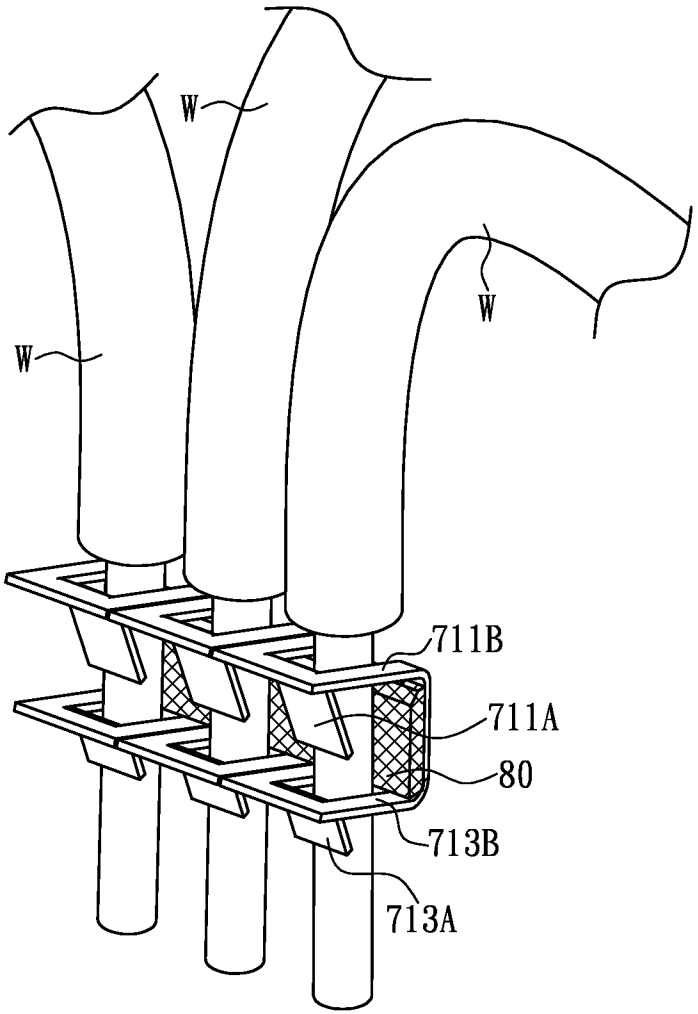
FIG. 14 is a perspective view showing the push-in connector according to certain embodiments of the present disclosure being connected with a plurality of electric wires.

With continued reference to FIG. 11 and FIG. 12, the busbar 80 can be a strip like element including a highly electrically conductive material such as copper or tin-coated copper, and serves mainly to connect with a power source. The bottom surface of the busbar 80 can be mounted on, or connected to, the top surface of the horizontal joining foot 712 in order to conduct the horizontal joining foot 712 and the terminal body 71 with the power source. The top surface of the busbar 80 is formed with an abutting surface 81 facing the insertion axes 718. Referring to FIG. 13, the configurations of, and therefore an configuration formed collectively by, the U-shaped slits 71C, the front and rear pressing spring fingers 711A and 713A, the front and rear pressing frames 711B and 713B, and the abutting surface 81 correspond to or match the cross-sectional configuration of the conductor C at a stripped end of an electric wire W so that when the conductor C at the stripped end of the electric wire W is passed sequentially through a corresponding pair of the U-shaped slits 71C, the conductor C at the stripped end of the electric wire W abuts securely against the free ends 71B of the corresponding pressing spring fingers 711A and 713A and a top portion of the abutting surface 81. The free end 71B of the corresponding front pressing spring finger 711A and the free end 71B of the corresponding rear pressing spring finger 713A are pressed respectively at different positioning points F3 and F2, that is, the "two points" according to the present disclosure, that are arranged along the corresponding insertion axis 718, on the top edge of the conductor C at the stripped end of the electric wire W and thereby force the bottom edge of the conductor C at the stripped end of the electric wire W, that is, the "one line" according to the present disclosure, to abut securely against the abutting surface 81 on the top side of the busbar 80. The conductor C at the stripped end of the electric wire W, therefore, can be mounted rapidly, conveniently, precisely, safely, and securely to the terminal body 71 by the "two-points-and-one-line" mechanism and be restrained in the corresponding front and rear pressing frames 711B and 713B (as shown in FIG. 14). Accordingly, the electric wire W can be confined to the aforesaid position and cannot be shifted horizontally to a great extent. Thus, each two adjacent electric wires W inserted into the push-in terminal will be kept from touching or pushing each other, and hence from being in electrical conduction with each other through the terminal body 71 and the busbar 80 as may otherwise occur if either wire is shifted horizontally to a great extent. In addition, the conductor C at the stripped end of each electric wire W and the push-in terminal will be kept from such abnormalities as being shifted horizontally to a great extent, twisting, or getting loose with respect to each other or separating from each other, thereby preventing tire accidents and malfunctions attributable to the aforesaid abnormalities.

Referring again to FIG. 10 to FIG. 13, a two-points-and-one-line push-in connector 70 capable of secure positioning, includes a terminal body 71, a busbar 80, and a housing 90. The terminal body 71 is formed by stamping and bending an elastic metal plate, has a U-shaped longitudinal cross section, and includes, sequentially in a front-to-rear direction, at least one front upstanding insertion leg 711, a horizontal joining foot 712, and at least cane rear upstanding insertion leg 13, The front and rear upstanding insertion legs 711 and 713 are joined to the front end and the rear end of the horizontal joining foot 712 respectively, and each of the joints between the upstanding insertion leg 711 and the horizontal joining loot 712 and between the rear upstanding insertion leg 713 and the horizontal joining foot 712 forms a bending line 716. With continued reference to FIG. 12, at east two slits 710 are formed in the elastic metal plate while the elastic metal plate is stamped to form the front upstanding insertion leg 711 and the rear upstanding insertion leg 713, which can divide the elastic metal plate into at least four independent sections 71A. Referring to FIG. 11 to FIG. 13, the elastic metal plate is formed with four slits 710 that divide the elastic metal plate into six independent sections 71A. The number of the slits 710 and the number of the independent sections 71A, however, are not limited to those disclosed herein and may be increased or decreased according to practical needs.

Each slit 710 extends downward from the top edge of the corresponding upstanding insertion leg 711 or 713 and terminates at a position adjacent to the corresponding bending line 716. Each independent section 71A further includes a U-shaped slit 71C formed by stamping. The U-shaped slits 71C are respectively formed in each of the front upstanding insertion leg 711 and the rear upstanding insertion leg 713. The U-shaped slits 71C formed respectively in the front upstanding insertion leg 711 and the rear upstanding insertion leg 713 correspond in pairs. The U-shaped slits 71C corresponding to each other be on the same insertion axis 718, and define a front pressing spring finger 711A and a front pressing frame 711B of the corresponding independent section 71A of the front upstanding insertion leg 711 and a rear pressing spring finger 713A and a rear pressing frame 713B of the corresponding independent section 71A of the rear upstanding insertion leg 713. Each of the front pressing spring finger 711A and the rear pressing spring linger 713A has one end integrally connected to the corresponding independent section 71A and an opposite free end 71B extending slantingly toward the rear end of the corresponding insertion axis 718. Moreover, the front and rear pressing frames 711B and 713B lying respectively on the same insertion axes 718 correspond to each other.

With continued reference to FIG. 11 and FIG. 12, the busbar 80 can be a strip-like element including a highly electrically conductive material such as copper or tin-coated copper, and serves mainly to connect with a power source. The bottom surface of the busbar 80 can be mounted on, or connected to, the top surface of the horizontal joining foot 712 in order to conduct the horizontal joining foot 712 and the terminal body 71 with the power source. The top surface of the busbar 80 is formed with an abutting surface 81 facing the insertion axes 718. Referring to FIG. 13, the configurations of, and therefore an configuration formed collectively by, the U-shaped slits 71C, the front and rear pressing spring fingers 711A and 713A, the front and rear pressing frames 711B and 713B, and the abutting surface 81 correspond to or match the cross-sectional configuration of the conductor C at a stripped end of an electric wire W so that when the conductor C at the stripped end of the electric wire W is passed sequentially through a corresponding pair of the U-shaped slits 71C, the conductor C at the stripped end of the electric wire W abuts securely against the free ends 71B of the corresponding pressing spring fingers 711A and 713A and a top portion of the abutting surface 81. The free end 71B of the corresponding front pressing spring finger 711A and the free end 71B of the corresponding rear pressing spring finger 713A are pressed respectively at different positioning points F3 and F2 arranged along the corresponding insertion axis 718 on the top edge of the conductor C at the stripped end of the electric wire W as the "two points" according to the present disclosure, and thereby force the bottom edge of the conductor C at the stripped end of the electric wire W to abut securely against the abutting surface 81 on the top side of the busbar 80 as the "one line"

according to the present disclosure. The conductor Cat the stripped end of the electric wire W, therefore, can be mounted rapidly, conveniently, precisely, safely, and securely to the terminal body 71 by the "two-points-and-one-line" mechanism and be restrained in the corresponding front and rear pressing frames 711B and 713B. Accordingly, the electric wire W can form an electrically conductive relationship with the busbar 80 through the terminal body 71. In addition, the conductor C at the stripped end of the electric wire W and the push-in terminal will be kept from such abnormalities as being shifted horizontally, twisting, or getting loose with respect to each other or separating from each other, thereby preventing fire accidents and malfunctions attributable to the aforesaid abnormalities.

Referring to FIG. 10 to FIG. 13, the housing 90 can made of an insulating material and include a hollow interior 91 and at least two connection ports 92. The configuration of the hollow interior 91 matches that of the push-in terminal (i.e., the terminal body 71 and the busbar 80 so that the push-in terminal can be mounted securely in the hollow interior 91. The connection ports 92 are formed at the front side of the housing 90 and are in communication with the hollow interior 91 so that the conductor C at a stripped end of an electric wire W can be inserted into the hollow interior 91 through any of the connection ports 92, passed through the corresponding U-shaped slits 71C along the corresponding insertion axis 718, held at a predetermined correct insertion position by the free ends 71B of the corresponding pressing spring fingers 711A and 713A, and pressed firmly against the abutting surface 81 of the busbar 80. It is thus ensured that thanks to the "two-points-and-one-line" positioning mechanism, the conductor C at a stripped end of an electric wire W inserted into the hollow interior 91 will not be twisted or damaged in the hollow interior 91 due to an abruptly changing environment, and that the conductor C at a stripped end of an electric wire W can always be rapidly and precisely inserted to a correct insertion position to transmit electrical signals stably and safely.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A push-in terminal, comprising:

a terminal body formed by stamping and bending an elastic metal plate, having: a U-shaped longitudinal cross section, and comprising:

a horizontal joining foot having a front end and a rear end;

at least one front upstanding insertion leg jointed to the front end of the horizontal joining foot, and formed with:

a first bending line at the joint between the front upstanding insertion leg and the horizontal joining foot; and at least one slit that divides the front upstanding insertion leg into at least two independent sections, each having a first U-shaped slit defining a front pressing frame and a front pressing spring finger having a free end and an opposite end integrally connected to the independent section, extends downward from a top edge of the front upstanding insertion leg, and terminates at a position adjacent to the first bending line; and at least one rear upstanding insertion leg jointed to the rear end of the horizontal joining foot, and formed with:

a second bending line at the joint between the rear upstanding insertion leg and the horizontal joining foot; and at least one slit that divides the rear upstanding insertion leg into at least two independent sections, each having a second U-shaped slit defining a rear pressing frame and a rear pressing spring linger having a free end and an opposite end integrally connected to the independent section, extends downward from a top edge of the rear upstanding insertion leg, and terminates at a position adjacent to the second bending line, wherein the first U-shaped slit and the corresponding second U-shaped slit lie on the same insertion axis, the front pressing frame and the rear pressing frame that lie on the same insertion axis correspond to each other, and the free ends of the front pressing spring finger and the rear pressing spring finger extend slantingly toward an rear end of the insertion axis and are configured to abut against a conductor at a stripped end of an electric wire; and an electrically conductive busbar configured to be mounted on a top surface of the horizontal joining foot and to conduct the horizontal joining foot and the terminal body with a power source, and having an abutting surface formed on a top surface of the busbar that faces the insertion axes and configured to abut against the conductor, grip, along with the free ends of the front pressing spring finger and the rear pressing spring finger, the conductor in the push-in terminal, and restrain, along with the free ends of the front pressing spring finger and the rear pressing spring finger, the conductor in the corresponding front pressing frame and rear pressing frame.

2. The push-in terminal according to claim 1, wherein a configuration collectively formed by the first U-shaped slit, the second U-shaped slit, the front pressing spring finger, the rear pressing spring finger, the front pressing frame and the rear pressing frame corresponds to a cross-sectional configuration of the conductor so that the free ends of the front pressing spring finger and the rear pressing spring finger and the abutting surface respectively abut against the conductor to grip the conductor in the push-in terminal and conduct the conductor with the busbar once the conductor has been sequentially passed the first U-shaped slit and the second U-shaped slit.

3. A push-in connector, comprising:

a terminal body formed by stamping and bending an elastic metal plate, having a U-shaped longitudinal cross section, and comprising:

a horizontal joining foot having a front end and a rear end;

at least one front upstanding insertion leg jointed to the front end of the horizontal joining foot, and formed with:

a first bending line at the joint between the front upstanding insertion leg and the horizontal joining foot; and at least one slit that divides the front upstanding insertion leg into at least two independent sections, each having a first U-shaped slit defining a front pressing frame and a front pressing spring finger having a free end and an opposite end integrally connected to the independent section, extends downward from a top edge of the front upstanding insertion leg, and terminates at a position adjacent to the first bending line; and at least one rear upstanding insertion leg jointed to the rear end of the horizontal joining foot, and formed with:

a second bending line at the joint between the rear upstanding insertion leg and the horizontal joining foot; and at least one slit that divides the rear upstanding insertion leg, into at least two independent sections, each having a second U-shaped slit defining a rear pressing frame and a rear pressing spring finger having a free end and an opposite end integrally connected to the independent section, extends downward from a top edge of the rear upstanding insertion leg, and terminates at a position adjacent to the second bending line, wherein the first U-shaped slit and the corresponding second U-shaped slit lie on the same insertion axis, the front pressing frame and the rear pressing frame that lie on the same insertion axis correspond to each other, and the free ends of the front pressing spring finger and the rear pressing spring finger extend slantingly toward an rear end of the insertion axis and are configured to abut against conductor at a stripped end of an electric wire;

an electrically conductive busbar configured to be mounted on a top surface of the horizontal joining foot and to conduct the horizontal joining foot and the terminal body with a power source, and having an abutting surface formed on a top surface of the busbar that faces the insertion axes and configured to abut against the conductor, and grip, along with the free ends of the front pressing spring finger and the rear pressing spring finger, the conductor in the push-in terminal; and an insulative housing, having:

a hollow interior for mounting the terminal body therein, having a configuration matching a configuration of the terminal body; and at least two connection ports, each formed at a front side of the housing, in communication with the hollow interior, and configured to be inserted with the conductor.

4. The push-in connector according to claim 3, wherein a configuration collectively formed by the first U-shaped slit, the second U-shaped slit, the front pressing spring finger, the rear pressing spring finger, the front pressing frame and the rear pressing frame corresponds to a cross-sectional configuration of the conductor so that the free ends of the front pressing spring finger and the rear pressing spring finger and the abutting surface respectively abut against the conductor to grip the conductor in the push-in connector and conduct the conductor with the busbar once the conductor has been sequentially passed the first U-shaped slit and the second U-shaped slit.

* * * * *